US009790671B2

(12) United States Patent
Jones et al.

(10) Patent No.: US 9,790,671 B2
(45) **Date of Patent: *Oct. 17, 2017**

(54) SURFACE EXTENSION ATTACHMENT DEVICE

(71) Applicant: August Concepts LLC, Larksville, PA (US)

(72) Inventors: Wayne David Jones, Larksville, PA (US); David McClanahan, Harleysville, PA (US)

(73) Assignee: Wayne David Jones, Larksville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/445,024

(22) Filed: Jul. 28, 2014

(65) Prior Publication Data

US 2015/0197926 A1 Jul. 16, 2015

Related U.S. Application Data

(63) Continuation-in-part of application No. 13/840,638, filed on Mar. 15, 2013, now Pat. No. 9,226,621.

(51) Int. Cl.
*E03C 1/181* (2006.01)
*A47J 47/20* (2006.01)

(52) U.S. Cl.
CPC ..... *E03C 1/181* (2013.01); *A47J 47/20* (2013.01)

(58) Field of Classification Search
CPC ..... E03C 1/181; A47J 47/20
See application file for complete search history.

(56) References Cited

U.S. PATENT DOCUMENTS

| | | | | | |
|---|---|---|---|---|---|
| 1,225,308 | A * | 5/1917 | Born | A47J 47/20 | 4/290 |
| 2,508,808 | A * | 5/1950 | Warman | A47J 47/20 | 4/658 |
| 6,253,395 | B1 * | 7/2001 | Quam | E03C 1/181 | 4/300.3 |
| 2008/0263762 | A1 * | 10/2008 | Burns | A47J 47/20 | 4/657 |
| 2009/0158520 | A1 * | 6/2009 | Richardson | A47K 3/024 | 4/572.1 |
| 2012/0125728 | A1 * | 5/2012 | Tamarkin | A45C 5/04 | 190/13 R |
| 2012/0285879 | A1 * | 11/2012 | Housley | A47J 43/24 | 210/249 |

* cited by examiner

*Primary Examiner* — Janie Loeppke
(74) *Attorney, Agent, or Firm* — Richard Mark Blank, Esquire

(57) ABSTRACT

The disclosed invention is a surface extension attachment device that easily attaches and detaches to surfaces, basins, and sinks to prevent water, liquids and other materials from splashing onto, squirting, spraying, and/or wetting person(s), place(s), and/or thing(s) while using the basin, sink, or other surface, including when washing hands or utensils. At least one panel of the present invention can be made of a flexible plastic and can be made to fold over itself and can include a means to attach to itself, such that the user has the option to fold this device out of the way or remove it, when it is not needed.

3 Claims, 31 Drawing Sheets

SURFACE EXTENSION ATTACHMENT DEVICE

CROSS-REFERENCE TO RELATED APPLICATIONS

This application is a continuation-in-part of U.S. Non-provisional Utility patent application Ser. No. 13/840,638, filed Mar. 15, 2013.

FIELD OF THE INVENTION

The disclosed invention relates to a device that is easily attached to a sink, basin or other surface to prevent water, other liquids, or other materials from splashing, splashing onto, squirting, spraying, and/or wetting person(s), place(s), and/or thing(s) such as sinks, basins, or other surfaces.

BACKGROUND OF THE INVENTION

Dishwashing machines are used in many homes, but they have their limitations. Even with a dishwashing machine, many things such as oversized pots need to be cleaned by hand in the sink, or basin. There are also homes with no dishwashing machines and thus there is no other option than to wash the dishes by hand. Getting splashed or sprayed is a common consequence of washing by hand.

One could wear an apron, but it would be easier to have a convenient shield in the sink, basin or other surface to prevent the person from being splashed or sprayed. The current invention would be low profile, easy to use and easy to store. The appearance of the device can be enhanced by placing a logo on it, such as that of a sports team.

In at least one embodiment, the invention would be tablet shaped having one or a plurality of suction cups or other attaching device(s) attached to the bottom portion of a panel or other extension attachment, piece, unit, or device. The suction cup(s), or other attaching device, are used to easily attach and detach the invention from a sink wall directly in front of the person performing the washing function. The invention could be made of a flexible plastic material and further have the ability to fold over itself roughly in half, attach to itself and/or be stored out of the way, and/or retracting the extended part for easy storage, while still attached to the sink. Alternatively, the invention can simply be removed from the sink or other surface when not needed and hung somewhere in the kitchen from an aperture in the panel or other extension attachment, piece, unit, or device.

SUMMARY OF THE INVENTION

The present invention is a surface extension attachment device that is comprised of at least one panel or other extension attachment, piece, unit, or device, at least one attaching device, and said at least one attaching device can attach said at least one panel or other extension attachment, piece, unit, or device to at least one surface or surface wall. The at least one surface or surface wall can be at least one surface or surface wall and be part of and/or located in or on at least one of the following: a basin, tub, sink, counter, cabinet, mirror, table, table top, work top, work bench, furniture, wall, floor, or person. Said at least one panel or other extension attachment, piece, unit, or device can be for at least one of the following: increasing the extension of said at least one surface or surface wall to protect a person's torso or other body part, other surface, furniture, wall, or floor from splashing liquid; increasing the vertical extension of said at least one surface or surface wall to protect a person's torso or other body part, other surface, furniture, wall or floor from splashing liquid; increasing the horizontal extension of said at least one surface or surface wall to protect a person's torso or other body part, other surface, furniture, wall, or floor from splashing liquid; increasing the vertical and/or horizontal extension of said at least one surface or surface wall to protect a person's torso or other body part, other surface, furniture, wall, or floor from splashing liquid; acting as a shield by extending beyond said at least one surface or surface wall; acting as a splash shield by extending beyond said at least one surface or surface wall; and/or acting as a shield for said torso and/or other body part(s) by extending vertically beyond said at least one surface or surface wall with said at least one panel or other extension attachment, piece, unit, or device being maintained between said torso and/or other body parts and said at least one surface or surface wall, thereby allowing at least one user to reach around said at least one panel or other extension attachment, piece, unit, or device into or onto said at least one surface or surface wall.

Said at least one attaching device can be comprised of at least one of the following: at least one suction cup, at least two suction cups, at least one suction cup at a bottom portion and/or on one side of the at least one panel or other extension attachment, piece, unit, or device, and/or at least two suction cups at a bottom portion and/or on one side of the at least one panel or other extension attachment, piece, unit, or device. Said at least one panel or other extension attachment, piece, unit, or device can have at least one of the following: parts that are detachably connected to at least one base or other structure, at least one bottom detachably connected to at least one base or other structure, at least one of its parts connected to at least one base or other structure, and/or at least one bottom connected to at least one base or other structure. Said at least one base or other structure can have at least one of the following: at least one suction cup on one side with said at least one suction cup attaching said at least one base or other structure to the at least one surface or surface wall, and/or at least two suction cups on one side with said suction cups attaching said at least one base or other structure to the at least one surface or surface wall. Said at least one panel or other extension attachment, piece, unit, or device can be easily attached and removed from said at least one base or other structure. Said at least one panel or other extension attachment, piece, unit, or device can further comprise at least one aperture to hang said at least one panel or other extension attachment, piece, unit, or device from when said at least one panel or other extension attachment, piece, unit, or device is removed from said at least one surface or surface wall.

The at least one panel or other extension attachment, piece, unit, or device can be made of at least one of the following materials in whole or in part: high-density polyethylene, acrylonitrile butadiene styrene, low-density polyethylene, silicone, plastic, metal, glass, rubber, polypropylene or polyvinyl chloride. The height of the panel or other extension attachment piece unit, or device can be between 5 to 20 inches. The width of the panel or other extension attachment, piece, unit, or device can be between 7.5 to 20 inches. The thickness of the panel or other extension attachment, piece, unit, or device can be between 0.020 to 0.062 mils. The at least one panel or other extension attachment, piece, unit, or device can further comprise at least one storage mechanism that stores, withdraws, slides, or retracts said at least one panel or other extension, attachment, piece, unit, or device while said at least one panel or other extension, attachment, piece, unit, or device is attached to the at least one surface, surface wall, or base. Said panel or other extension attachment, piece, unit, or device can be made of a flexible plastic material, and can fold over itself and attaches to itself in a manner such that the panel or other extension attachment, piece, unit, or device remains attached to at least one surface or surface wall.

The at least one panel or other extension attachment, piece, unit, or device can further comprise at least one of the following: at least one indent at a bottom edge of the panel or other extension attachment, piece, unit, or device having at least one protrusion tab between said at least one indent, at least two indents at a bottom edge of the panel or other extension attachment, piece, unit, or device having at least one protrusion tab between said at least two indents, and/or said at least one aperture being located near the top portion of said panel or other extension attachment, piece, unit, or device so when the panel or other extension attachment, piece, unit, or device folds over itself, the at least one aperture is hooked onto said at least one protrusion tab and holds the at least one panel or other extension attachment, piece, unit, or device in a folded-over configuration. The at least one panel or other extension attachment, piece, unit, or device can further comprise at least one protrusion extension tab extending from a bottom edge of the panel or other extension attachment, piece, unit, or device, and said at least one aperture can be located near the top portion of said at least one panel or other extension attachment, piece, unit, or device so when the at least one panel or other extension attachment, piece, unit, or device folds over itself, the at least one aperture is hooked onto said at least one protrusion extension tab and holds the at least one panel or other extension attachment, piece, unit, or device in a folded-over configuration. The at least one panel or other extension attachment, piece, unit, or device can be shaped as a dome side to side when said at least one panel or other extension attachment, piece, unit, or device is in an unfolded, upright position.

The at least one panel or other extension attachment, piece, unit, or device can further comprise at least one of the following: said suction cup(s) that can have stems that are first placed through keyway apertures in a bar and then placed through keyway apertures in the bottom portion of said at least one panel or other extension attachment, piece, unit, or device; said suction cup(s) can be secured to a smaller section of the keyway apertures in a bar, and keyway apertures in the bottom portion of said at least one panel or other extension attachment, piece, unit, or device; the structure can be a dome shape of the at least one panel or other extension attachment, piece, unit, or device being maintained by the placement of said suction cups having a narrower configuration than a distance between keyway apertures in the at least one panel or other extension attachment, piece, unit, or device; and/or said bar keeping said suction cup(s) in proper narrower configuration. The dome shape of the at least one panel or other extension attachment, piece, unit, or device can be formed by: the at least two suction cups being two suction cups placed at an outside, front, bottom portion of said at least one panel or other extension attachment, piece, unit, or device, and having stems of equal height dimension, and a third suction cup being placed on an inside, front, bottom portion of said at least one panel or other extension attachment, piece, unit, or device between said at least two suction cups, and having a stem longer than the dimension of the at least two suction cup stems.

The at least one panel or other extension attachment, piece, unit, or device can further comprise: at least three suction cups on a front bottom side of the at least panel or other extension attachment, piece, unit, or device, the at least three suction cups having stems that are first positioned through corresponding apertures in a base, the stems of the at least three suction cups being positioned through corresponding apertures in the bottom of said at least one panel or other extension attachment, piece, unit, or device after said stems of the at least three suction cups are positioned through the base, and said at least one panel or other extension attachment, piece, unit, or device being removable from the stems of the at least three suction cups, such that the base and suction cups stay attached to said at least one surface or surface wall, and said at least one panel or other extension attachment, piece, unit, or device being removable and stored by hanging said at least one panel or other extension attachment, piece, unit, or device from at least one aperture on said at least one panel or other extension attachment, piece, unit, or device.

The at least one panel or other extension attachment, piece, unit, or device can further comprise: said at least one panel or other extension attachment, piece, unit, or device being tablet shaped with a flanged rectangular shaped portion at a bottom of said at least one panel or other extension attachment, piece, unit, or device; said flanged rectangular shaped portion being narrower in width than said tablet shaped at least one panel or other extension attachment, piece, unit, or device, and further comprising a latch aperture; a base having a semicircular recess on an inferior aspect, and further comprising a circular latch protrusion and a capture lip on a front side of said base; said at least one panel or other extension attachment, piece, unit, or device attaching to said base by placing said flanged rectangular shaped portion onto said capture lip and said latch protrusion, such that the latch protrusion of said base engages with the latch aperture of the at least one panel or other extension attachment, piece, unit, or device; and removing of said at least one panel or other extension attachment, piece, unit, or device from base by exerting pressure on an exposed portion of said at least one panel or other extension attachment, piece, unit, or device that is located below the semicircular recess, which disengages the latch aperture from the latch protrusion and releases the at least one panel or other extension attachment, piece, unit, or device from the base. The at least one panel or other extension attachment, piece, unit, or device of can further comprise a contour area at the top of the at least panel or other extension attachment, piece, unit, or device. The at least one panel or other extension attachment, piece, unit, or device can have at least one butterfly hinged area to fold the at least one panel or other extension attachment, piece, unit, or device and cause the at least one panel or other extension attachment, piece, unit, or device to invert into an upright position. The at least one butterfly hinged area can be formed by at least one of the following ways: being vacuum formed; and/or being made of a rubber or rubber-like material with the other areas of the at least one panel or other extension attachment, piece, unit, or device being made of a non-rubber or non-rubber-like material.

The at least one panel or other extension attachment, piece, unit, or device of can further comprise: an additional suction cup located at the bottom portion or top portion of said at least one panel or other extension attachment, piece, unit, or device on a side of the at least one panel or other extension attachment, piece, unit, or device that is opposite to the side of the at least one panel or other extension attachment, piece, unit, or device with the at least two suction cups; and when said at least one panel or other extension attachment, piece, unit, or device is folded over, the additional suction cup attaches to a folded over portion of said at least one panel or other extension attachment, piece, unit, or device and holds the at least one panel or other extension attachment, piece, unit, or device in said folded position. The at least one panel or other extension attachment, piece, unit, or device can further comprise: said at least one panel or other extension attachment, piece, unit, or device being an oval shape with at least one upper portion and a lower portion; and at least one living hinge and butterfly hinged area(s) between said upper and lower portions of said oval shaped at least one panel or other extension attachment, piece, unit, or device being used to fold the at least one panel or other extension attachment, piece, unit, or device. The at least one panel or other extension attachment, piece, unit, or device can further comprise: at least one living hinge between at least an upper portion and a bottom portion of said at least one panel or other extension attachment, piece, unit, or device used to fold the at least one panel or other extension attachment, piece, unit, or device; and an over center catch positioned on said living hinge, which holds the at least one panel or other extension attachment, piece, unit, or device in a substantially upright unfolded position when engaged. A top portion of said at least one panel or other extension attachment, piece, unit, or device can have at least one protrusion, or pin protrusion, and a bottom portion of said at least one panel or other extension attachment, piece, unit, or device has at least one corresponding socket, such that when the at least one protrusion, or pin protrusion is placed into the at least one socket, the at least one panel or other extension attachment, piece, unit, or device is held in a folded position. A top portion of said at least one panel or other extension attachment, piece, unit, or device can have at least one hook located on or near the top edge of said at least one panel or other extension attachment, piece, unit, or device, which snaps or attaches over a bottom edge of said at least one panel or other extension attachment, piece, unit, or device holding at least said panel or other extension attachment, piece, unit, or device in a folded position when said at least one panel or other extension attachment, piece, unit, or device is folded over said at least one hook.

Although preferred embodiments of the present invention have been described it will be understood by those skilled in the art that the present invention should not be limited to the described preferred embodiments. Rather, various changes and modifications can be made within the spirit and scope of the present invention.

Figure 1:
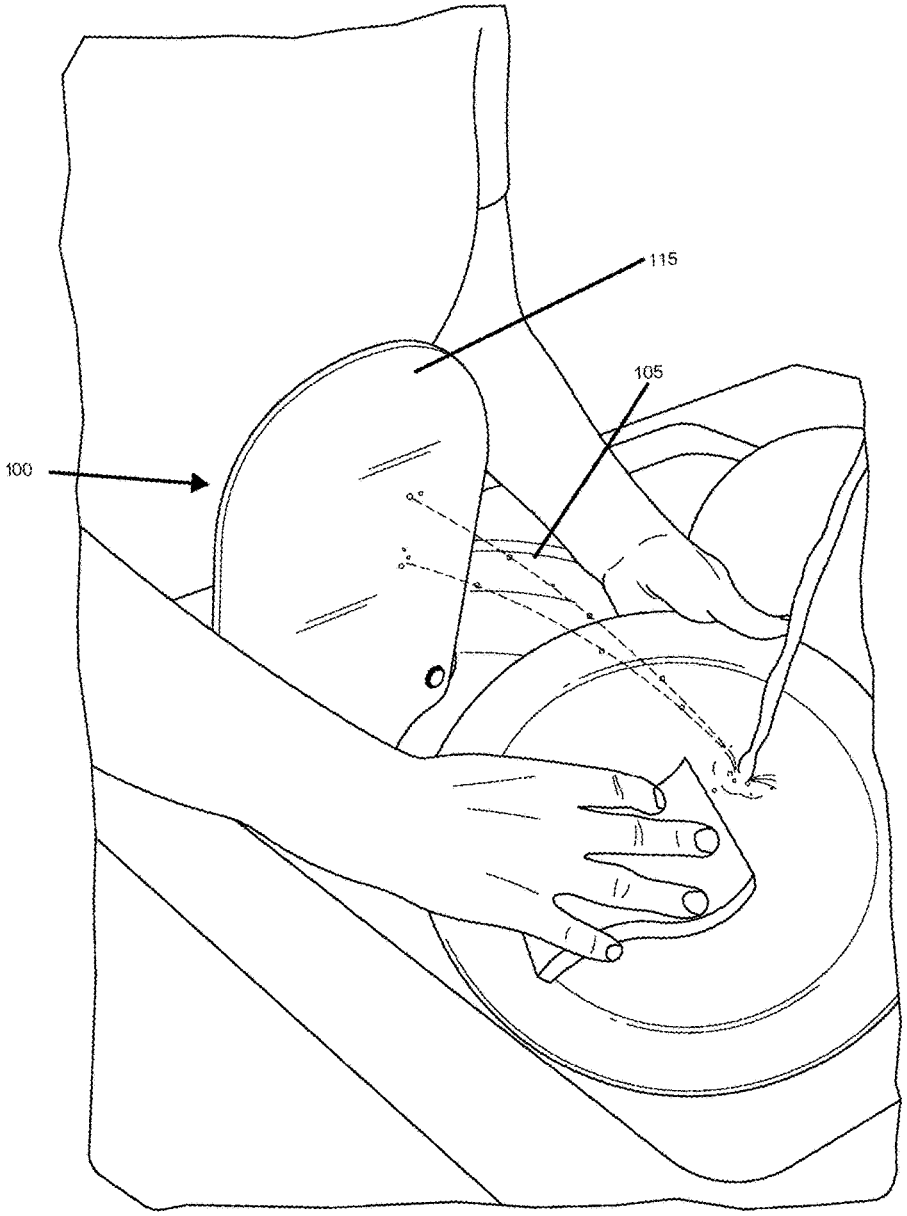
FIG. 1 is a perspective view of the invention in use while washing dishes.

A better understanding of the disclosed invention will be obtained from the following detailed description of the preferred embodiments, taken in conjunction with the drawings and the attached claims.

DETAILED DESCRIPTION OF THE DRAWINGS

The ensuing detailed description provides preferred exemplary embodiments only, and is not intended to limit the scope, applicability, or configuration of the disclosed invention. Rather, the ensuing detailed description of the preferred exemplary embodiments will provide those skilled in the art with an enabling description for implementing the preferred exemplary embodiments of the invention. Various changes may be made in the function and arrangement of elements without departing from the spirit and scope of the disclosed invention, as set forth in the appended claims.

To aid in describing the disclosed invention, directional terms may be used in the specification and claims to describe portions of the present invention (e.g., upper, lower, left, right, etc.). These directional definitions are merely intended to assist in describing and claiming the disclosed invention and are not intended to limit the disclosed invention in any way. In addition, reference numerals that are introduced in the specification in association with a drawing figure may be repeated in one or more subsequent figures without additional description in the specification, in order to provide context for other features.

With reference now to the drawings, a device for a SURFACE EXTENSION ATTACHMENT DEVICE (SOMETIMES REFERRED TO HEREIN AS SINK SPLASH GUARD) is shown.

Referring to FIG. 1, reference number 100 refers generally to a sink splash guard. This sink splash guard 100 has a panel 115 and is attached to sink or basin 105 and being used for protection from water splashes while a user is washing dishes. The panel 115 is preferably rectangular, tablet or oval shaped.

Figure 2:
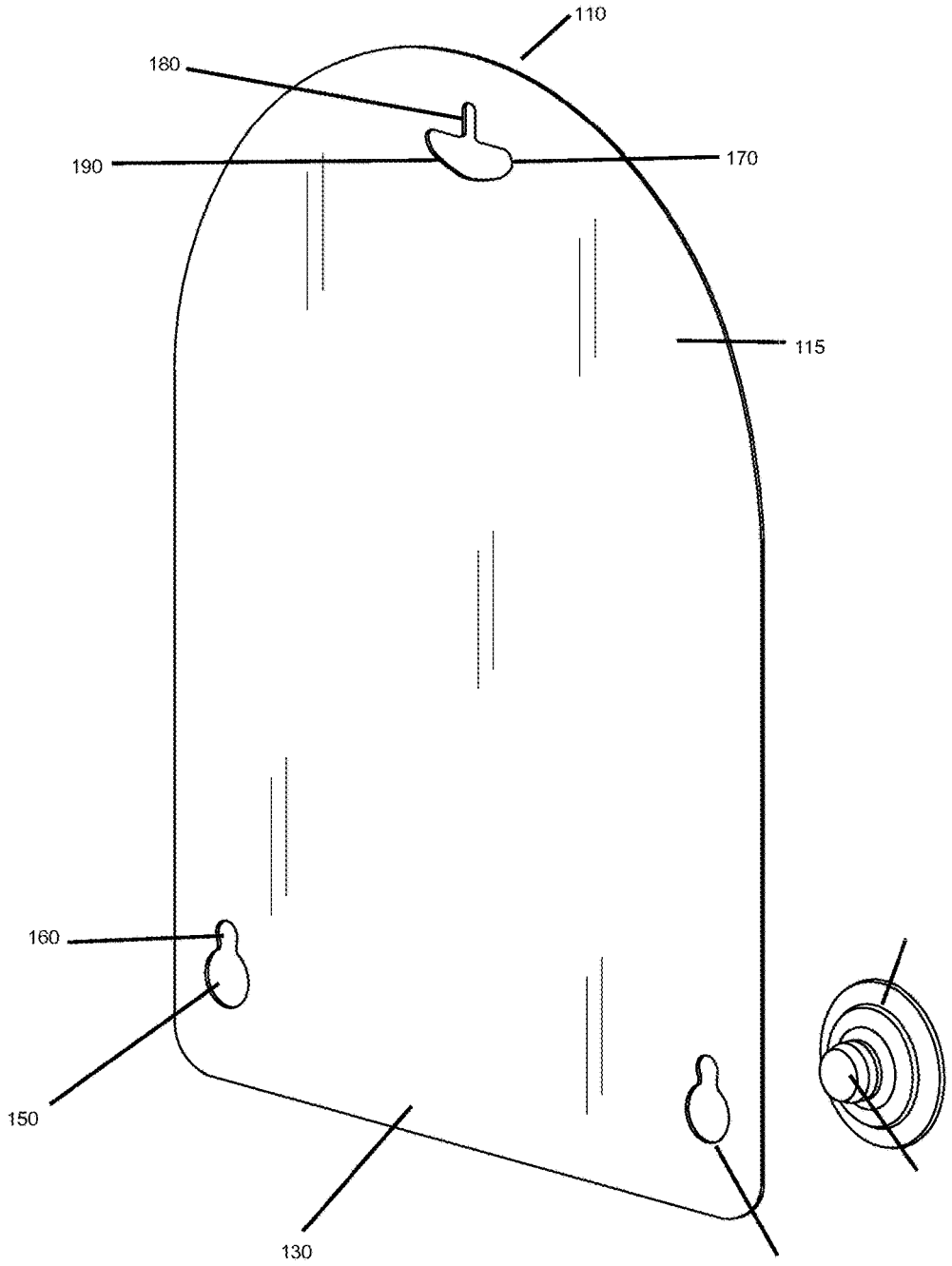
FIG. 2 shows a perspective view from the back of the first embodiment of the invention with suction cups not yet attached to the invention.
Figure 3:
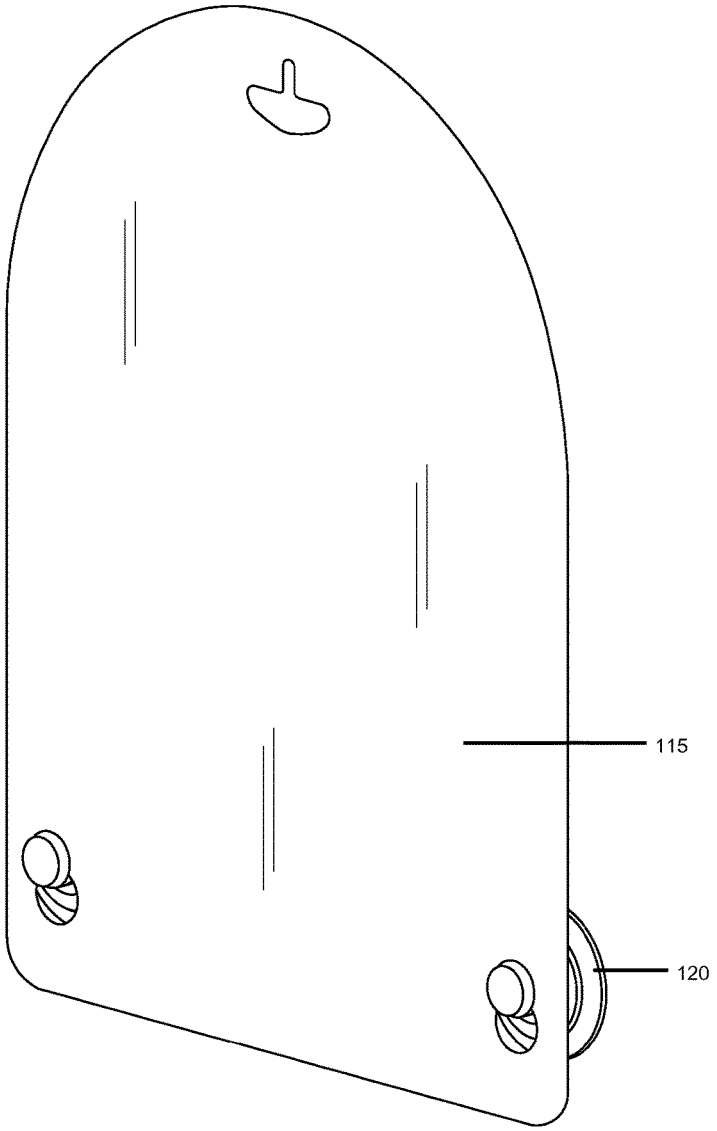
FIG. 3 shows a perspective view from the back of a first embodiment of the invention with the suction cups attached.

FIG. 2 shows the sink splash guard 100 that is a tablet shaped panel 115. Panel 115 has a top portion 110 and a bottom portion 130. FIG. 3 shows a plurality of suction cups 120 attached to the bottom section 130 of the panel 115. The suction cups 120 allow the sink splash guard 100 to easily attach to and detach from a sink or basin 105.

Also, in the first embodiment, the suction cups 120 have a mushroom type stem 125 with a narrowed groove area. The panel 115 further comprises a keyway aperture 140 having a larger section 150 and a narrower section 160. The sink splash guard is preferably made of any pliable plastic known in the art. Some of the preferred materials include but are not limited to high-density polyethylene, acrylonitrile butadiene styrene, low-density polyethylene, polypropylene, polyvinyl chloride, silicone, metal, glass, and rubber (commonly abbreviated PVC). The panel 115 is preferably die-cut from sheet stock. Alternatively, the panels can be made by vacuum forming or injection molding.

The size of the panel 115 varies to any size that works in a kitchen, laundry, utility or bathroom sink. The height of the panel 115 is preferably between 5 to 20 inches. The width of the panel 115 is between 7.5 to 20 inches. The thickness of the panel 115 is between 0.020 to 0.062 mils. The diameter of suction cups 120 are between 1.125 to 2.375 inches but preferably 1.75 inches when at rest. The diameter in use of suction cups 120 are between 1.25 and 2.5 inches and preferably 1.875 inches. Height of mushroom head 125 from top of cup is preferably 0.25 of an inch.

The suction cups 120 attach to the panel 115 by placing the stem 125 of suction cup 120 through keyway apertures 140 larger sections 150 and then lifting and snapping it into the aperture 140 narrower sections 160. Alternatively, the suction cup protrusions are simply pressed into round apertures as seen better in FIG. 13.

Figure 4:
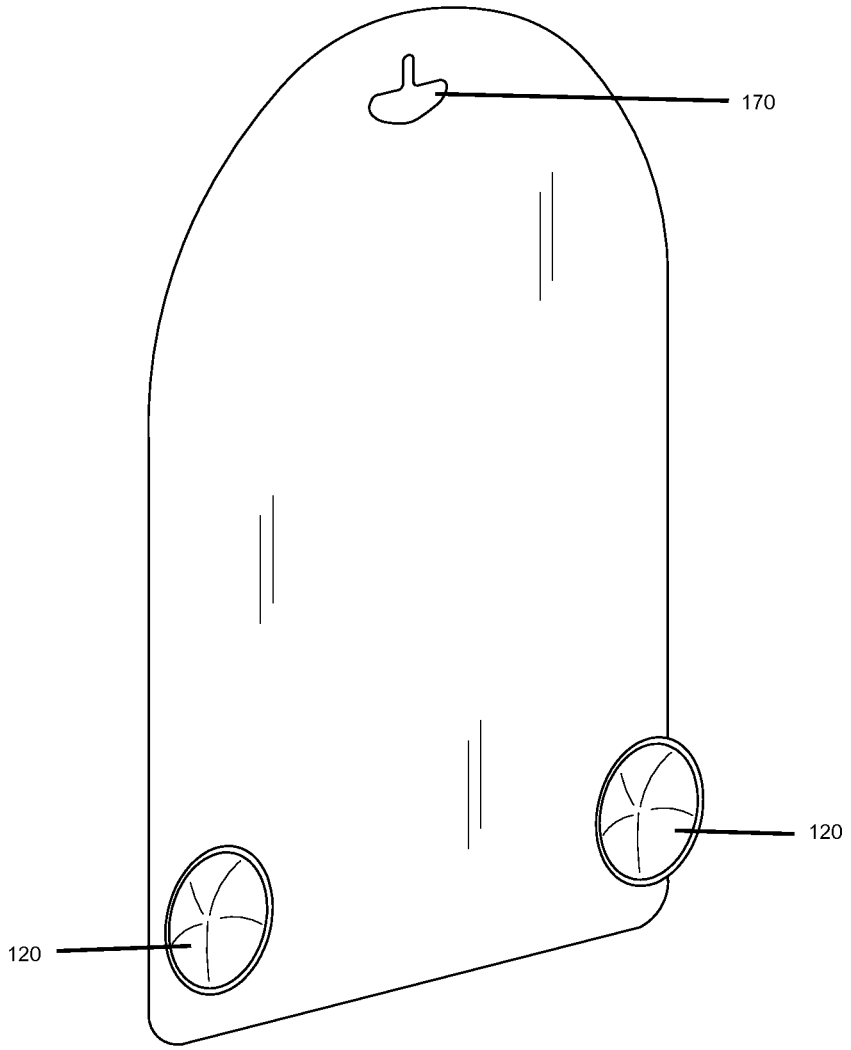
FIG. 4 is a perspective view from the front of a first embodiment of the invention.

Now referring to FIG. 4, the suction cups 120 once positioned in the keyway aperture 140 are in position to be used to attach the sink splash guard 100 to a sink 105. In this first embodiment the top portion 110 has an aperture 170 also having a narrow section 180 and a larger section 190. The sink splash guard 100 of the first embodiment is removed from a sink one of two ways. The first option is to release the suction cups 120 from the sink. The second option is to unhook the suction cup protrusion 125 from the keyway aperture 140 and leave the suction cups attached to the sink. After either method of removal, the sink splash guard 100 is preferably hung from a hook or similar item near the sink 105 from aperture 170.

Figure 5:
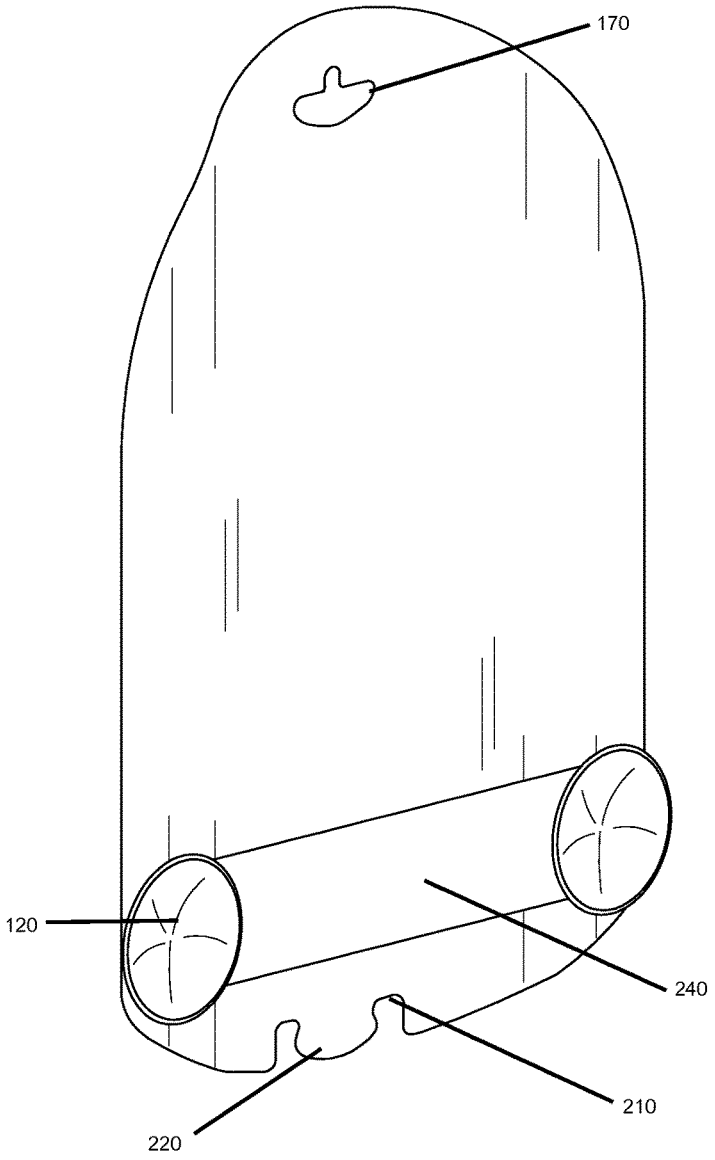
FIG. 5 is a perspective view from the front of a second embodiment of the disclosed invention.
Figure 6:
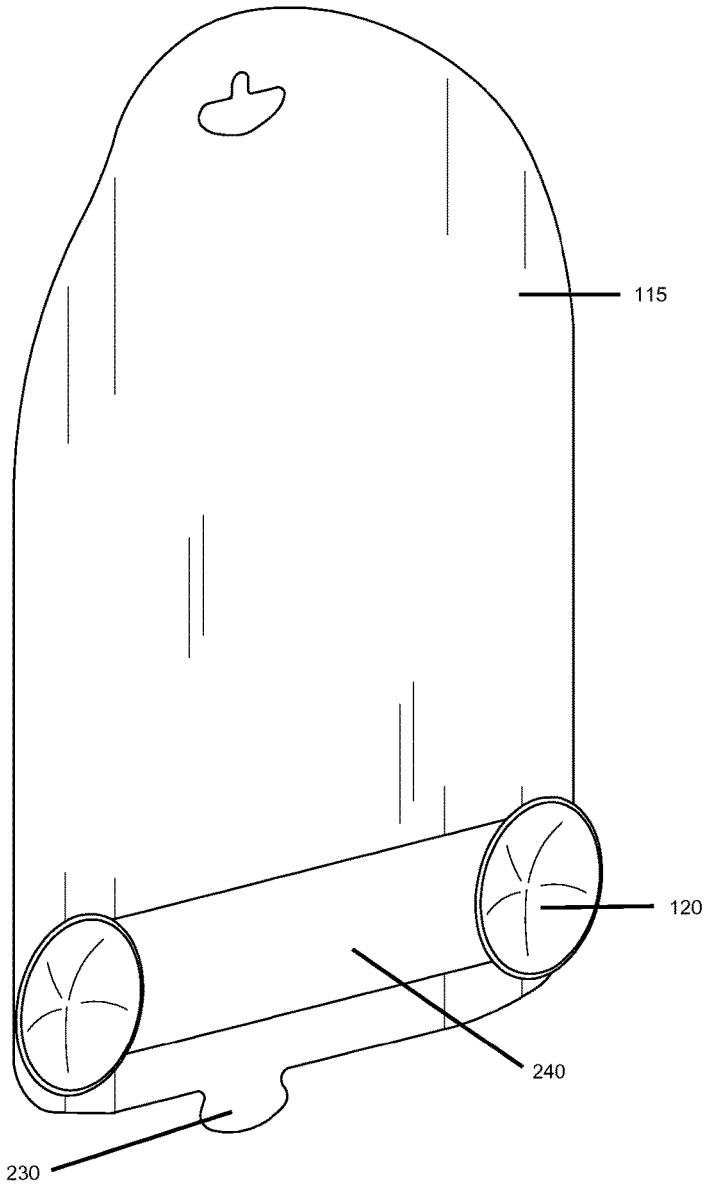
FIG. 6 is a perspective view from the front of a third embodiment of the disclosed invention.

FIG. 5 is a second embodiment of the sink splash guard 100. This embodiment has a bottom edge with two indents 210 creating a protrusion tab 220. FIG. 6 is a third embodiment of the sink splash guard 100 that now has a bottom edge with a protrusion extension tab 230 sticking out. The sink splash guard panel 115 is preferably made of a flexible plastic so that it can fold. In both embodiments two and three, as seen in FIGS. 5 and 6, the panel folds over itself and the top aperture's 170 bigger section 190 hooks onto protrusion tab 220 or protrusion extension tab 230.

Figure 9:
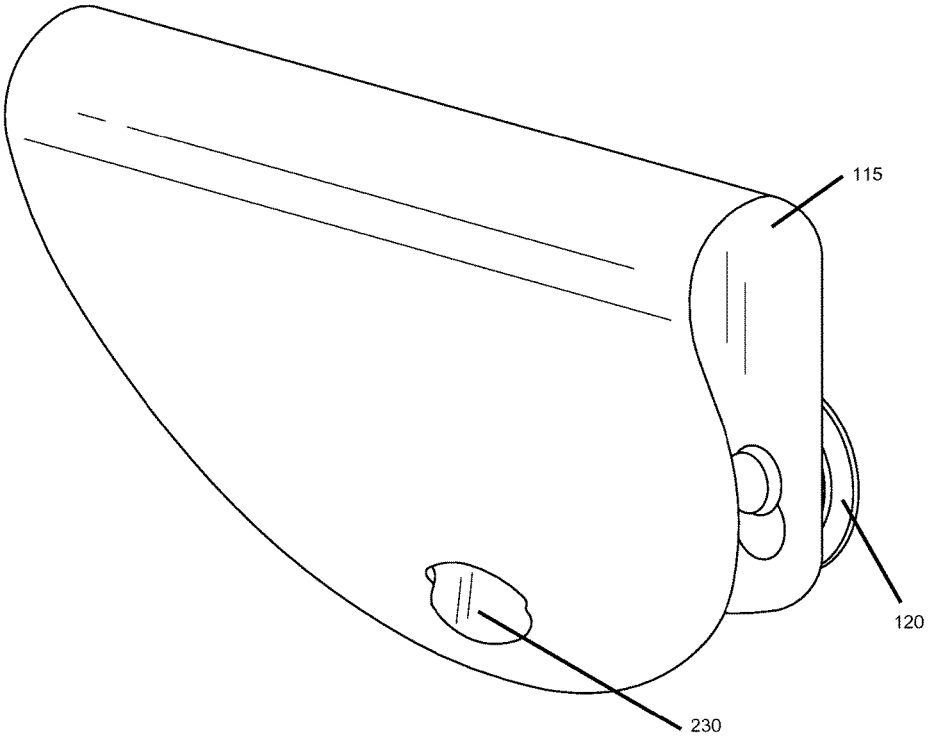
FIG. 9 is a perspective view of a third embodiment of the disclosed invention in a folded over position.

FIG. 9 shows panel 115 of embodiment three folded over itself. The top aperture's 170 bigger section 190 is hooked onto protrusion extension tap 230. Thus, the user has the option to fold the splash guard out of the way while still attached to the sink when it is not being used.

Figure 7:
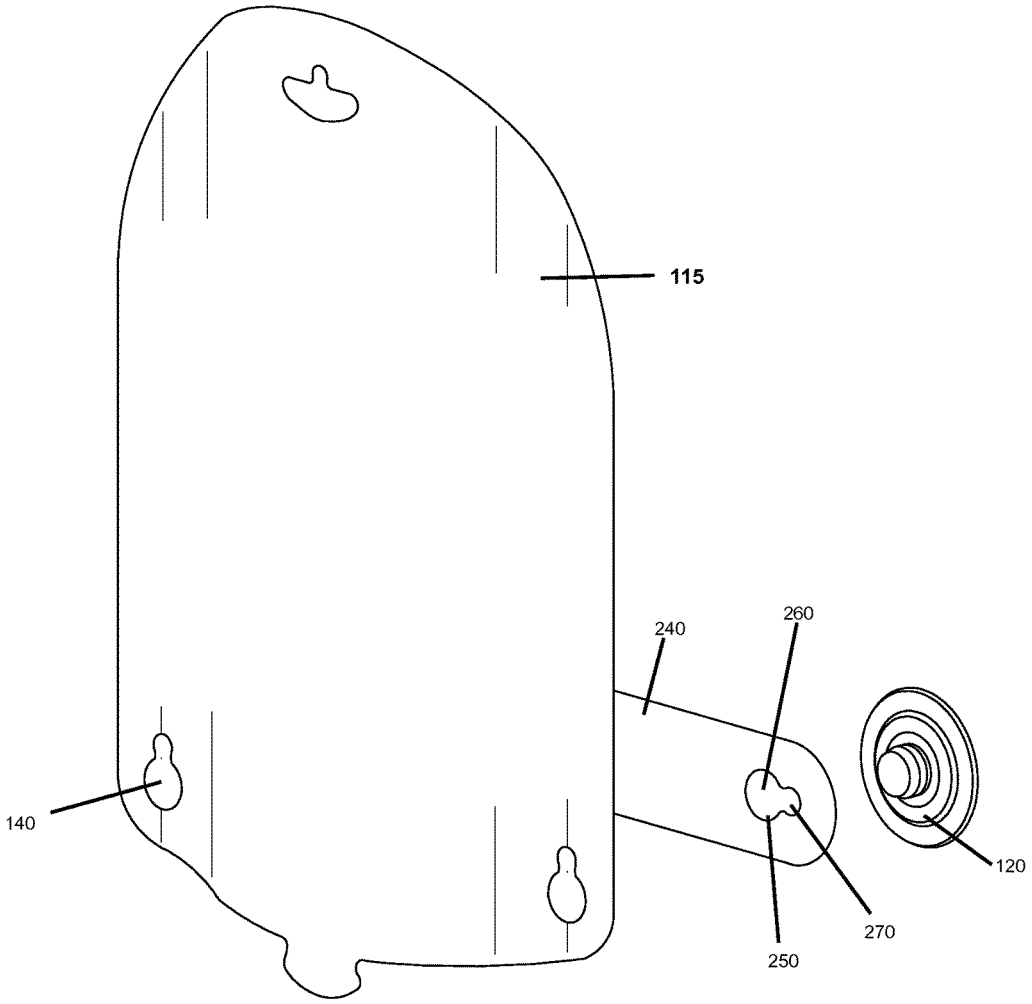
FIG. 7 is a perspective view from the back of a third embodiment of the disclosed invention.

FIG. 7 illustrates that both embodiments two and three further consist of a bar 240 configured between the suction cups 120 and keyway apertures 140. Bar 240 is preferably formed by a die cut process. The bar 240 has sideway keyway apertures 250 with a larger section 260 and narrower section 270. The narrower sections 270 are positioned towards the ends of the bar 240 on either side.

Figure 8:
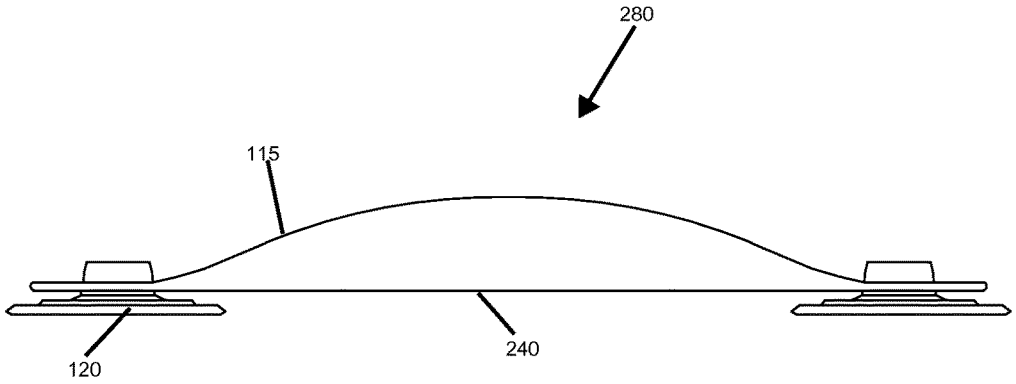
FIG. 8 is a top view of a third embodiment of the disclosed invention.

The panel 115 is forced into a side to side dome 280 as seen best in top view FIG. 8. The suction cup stems 125 are first placed through the side way keyway apertures 250 and secured into narrower sections 270. Then suction cup stems 125 are placed in panel keyways 140 and secured into narrower sections 160. The dome 280 is produced by reducing the distance between the suction cups 120 compared to the distance between the keyway apertures 140. This proper spacing is achieved by utilizing bar 240.

This dome 280 creates residual forces that are great enough to make the panel 115 regain its upright position after panel 115 has been unfolded. Once the suctions cups 120 are connected to the bar 240 and panel 115, the sink splash guard 100 is designed to stay together as a unit. However, the sink splash guard is easily disassembled for better cleaning and then easily re-assembled.

Figure 10:
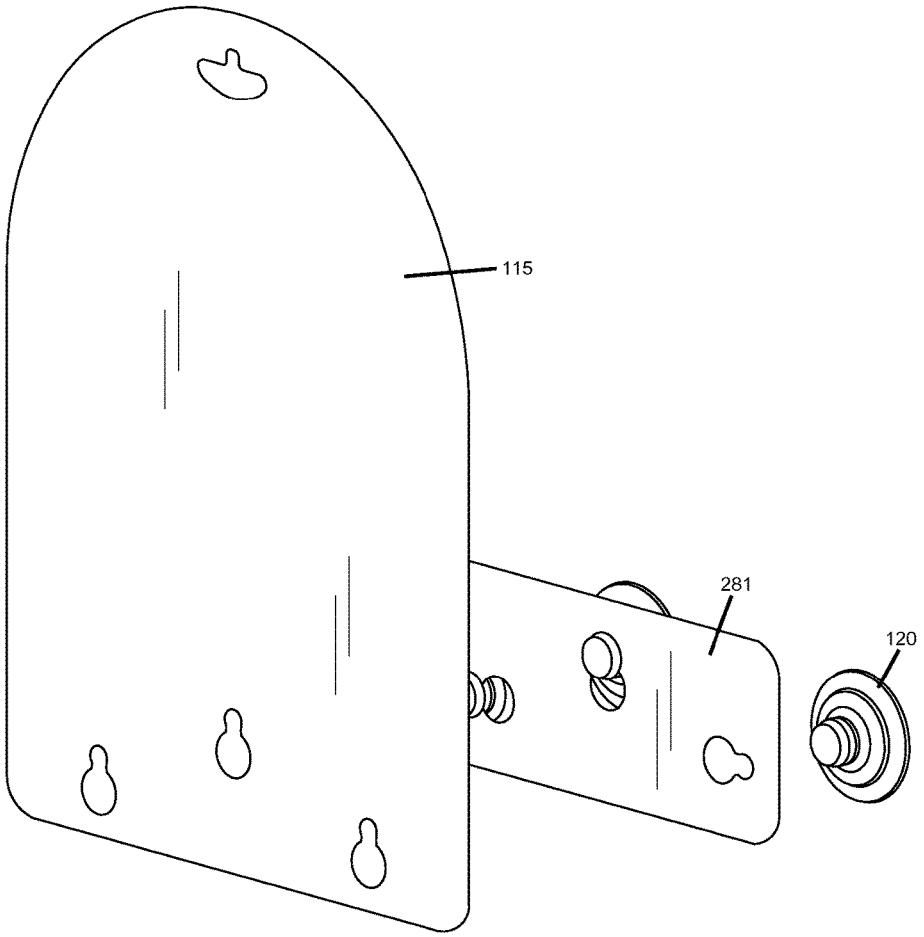
FIG. 10 is a perspective view from the back of a fourth embodiment of the disclosed invention.

FIG. 10 illustrates a fourth embodiment of the current invention. A second type of bar 281 is now between the suction cups 120 and the panel 115. In this embodiment there are now three suction cups 120. Both bar 240 and 281 assure that suction cups 120 are spaced properly. In this embodiment the bar 281 has the ability to stay with the suction cups 120 on the sink. Therefore, panel 115 is stored by removing it from the suction cups 120 and bar 281 and hanging it from aperture 170.

Figure 11:
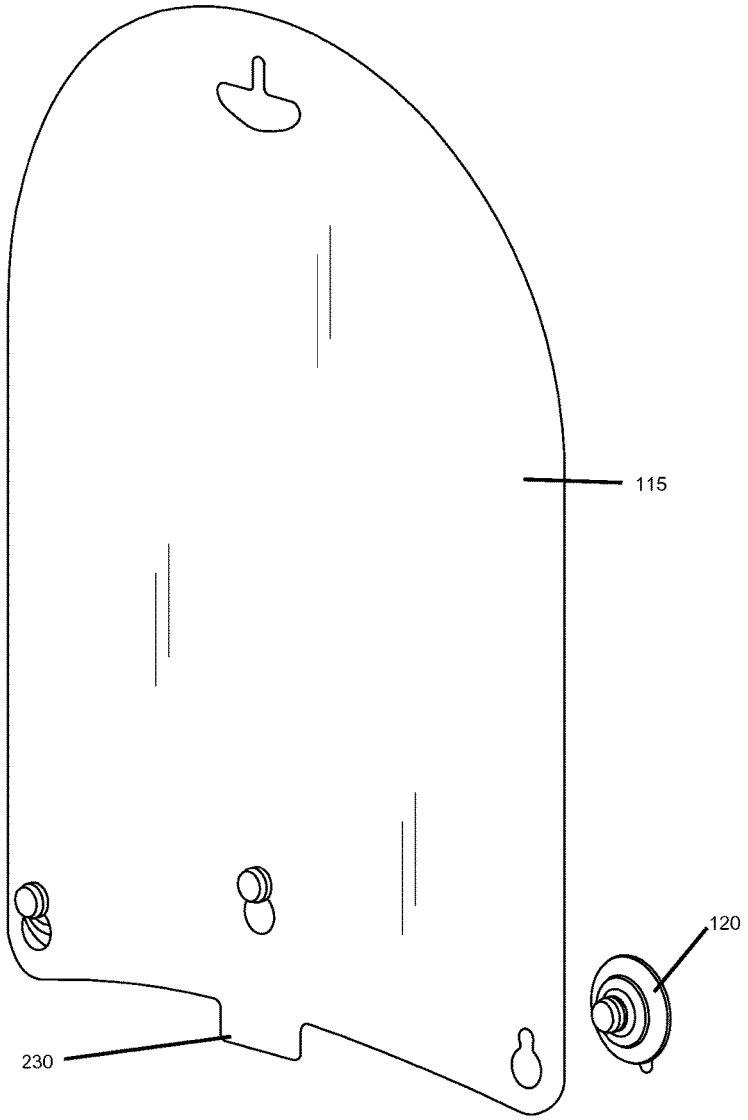
FIG. 11 is a perspective view from the back of a fifth embodiment of the disclosed invention.
Figure 12:
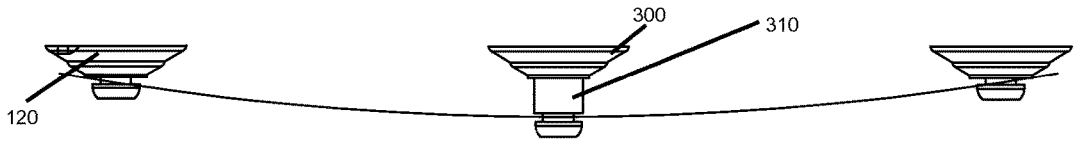
FIG. 12 is a bottom view of a fifth embodiment of the disclosed invention.

FIGS. 11 and 12 are a fifth embodiment of the current invention. This embodiment has a third suction cup 300 positioned at a midway point between the other two suction cups 120. This third suction cup 300 has a longer stem 310 than the two suction cups 120 on either end. Suction cup 300 height of mushroom head extending from top of suction cup is preferably 1 inch. This longer stem 310 is another way to create the dome effect as seen more clearly in FIG. 12. This embodiment also has a slight curve to the bottom edge of the panel 115.

A sixth embodiment of the sink splash guard is seen in FIGS. 13 through 16. Panel 116 is vacuum formed and there is contour 320 to help keep panel 116 stiff Panel 116 is substantially a tablet shape and further comprises a flange portion 365 at the bottom. This flange portion 365 is rectangular in shape and narrower than the width of panel 116. Panel 116 is detachably connected to a base 330.

Figure 13:
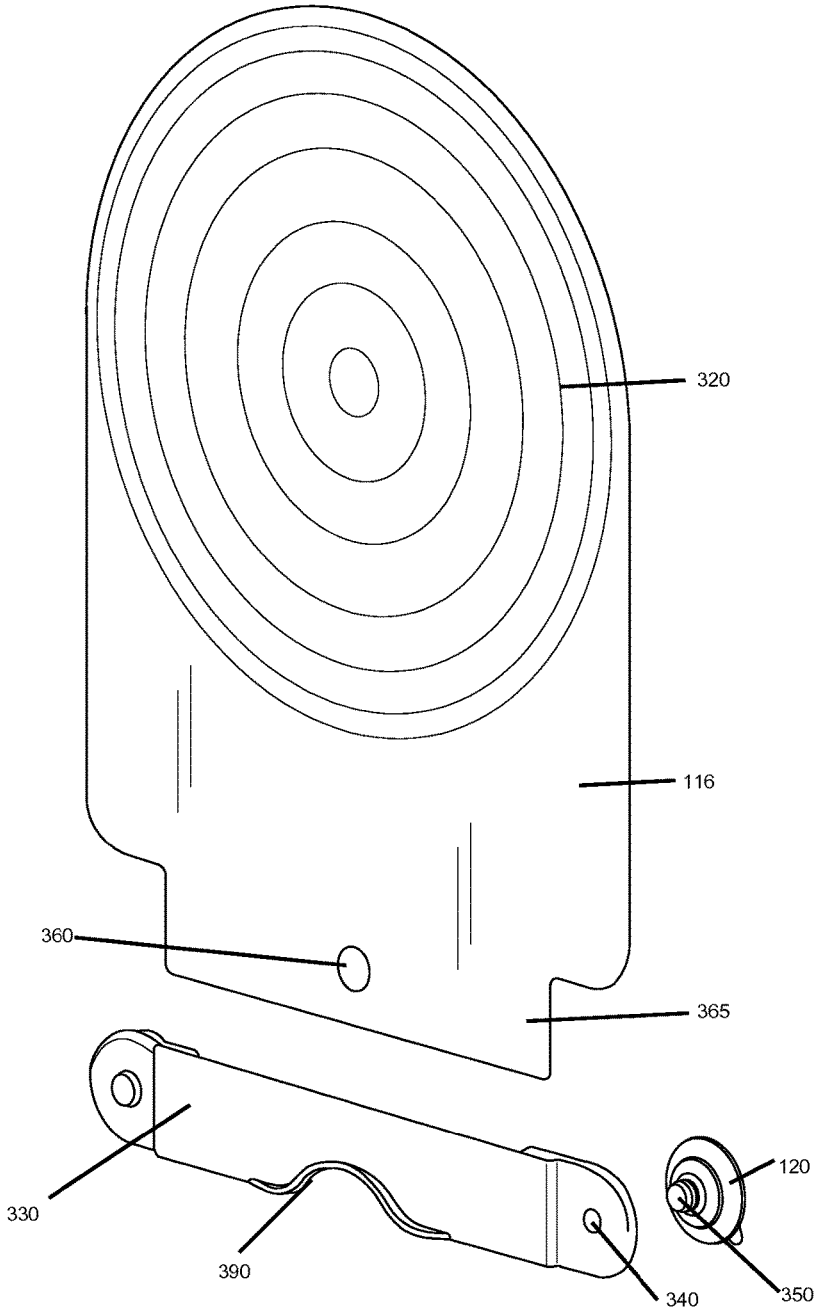
FIG. 13 is a perspective view from the back of a sixth embodiment of the disclosed invention.
Figure 14:
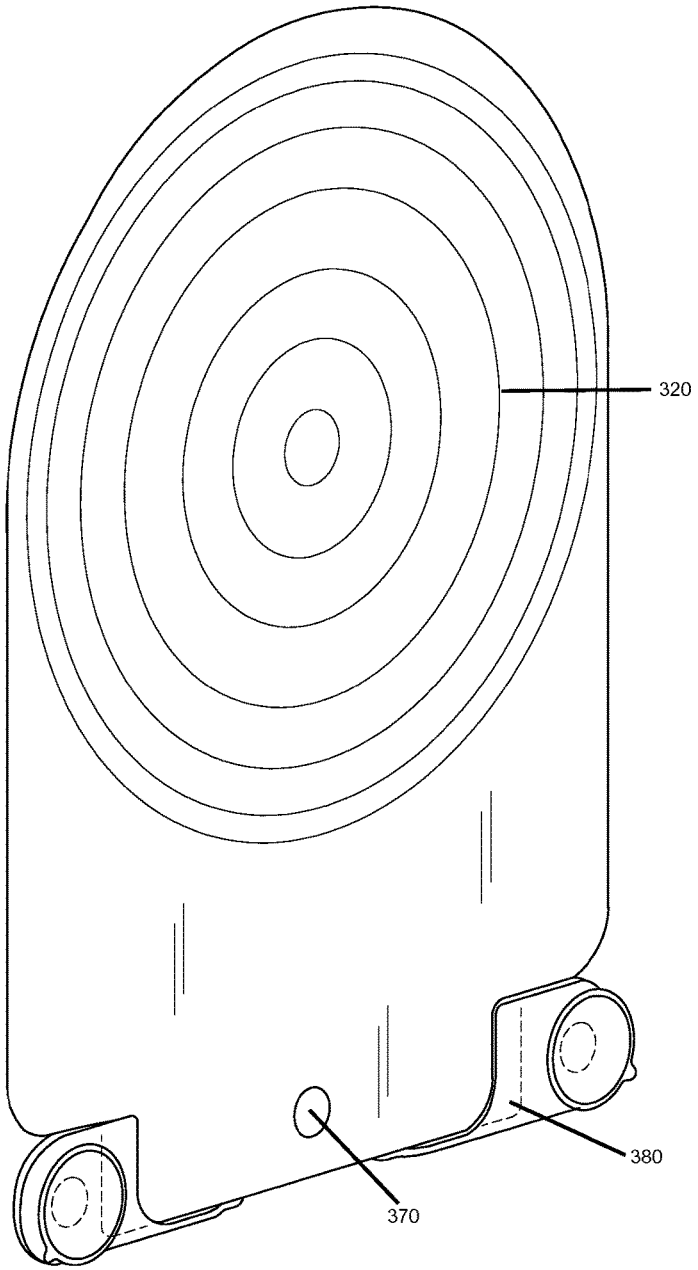
FIG. 14 is a perspective view from the front of a sixth embodiment of the disclosed invention.
Figure 15:
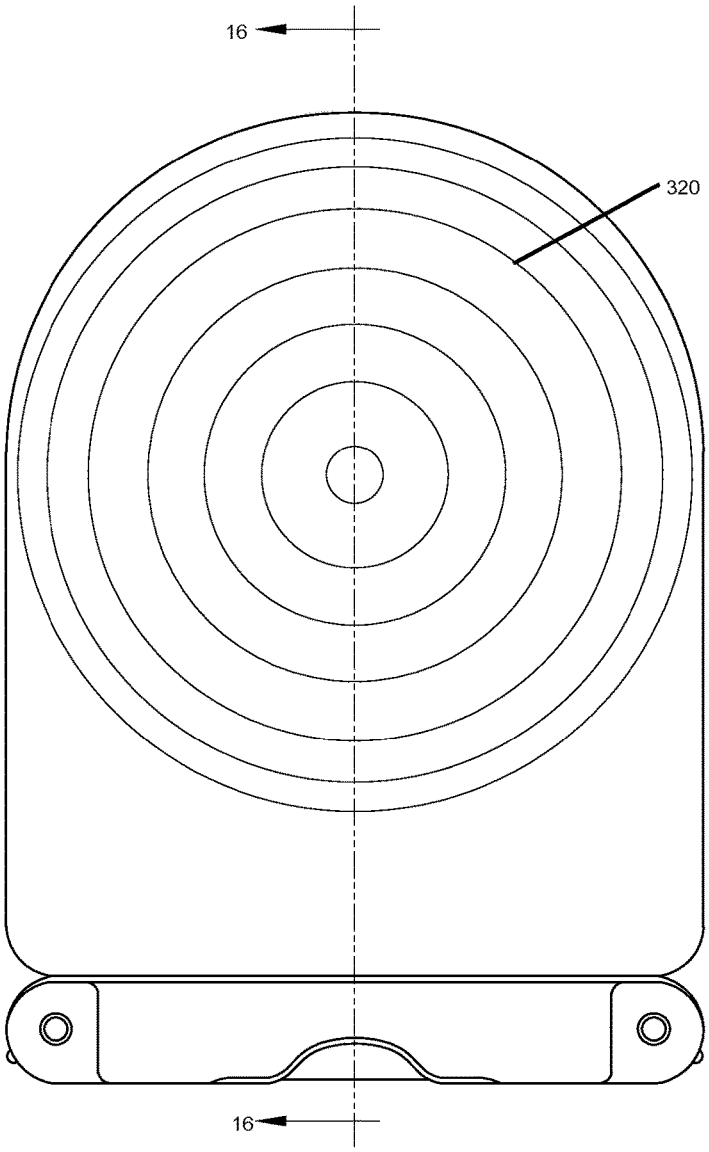
FIG. 15 is a back view of the sixth embodiment of the disclosed invention.
Figure 16:
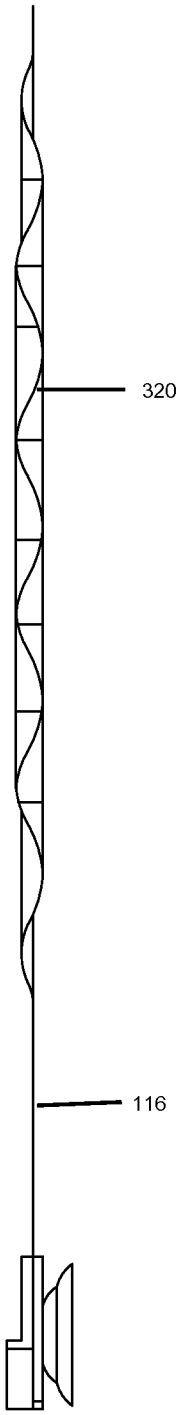
FIG. 16 is a cross sectional view of the sixth embodiment of the disclosed invention.

FIG. 13 shows the panel 116 apart from the base 330. Suction cups 120 have protrusions 350 that are simply pressed into the base through circular apertures 340. The bottom of panel 116 of the sixth embodiment has a latch aperture 360. The middle of base 330 has a circular latch protrusion 370 and a capture lip 380 on the front side of the base 330. Base 330 is preferably made by injection molding.

Panel 116 is placed into the base 330 and the latch protrusion 370 of base goes through the latch aperture 360 of panel 116. Panel 116 also sits on the capture lip 380 of base 330. The base 330 further comprises a semicircular recess 390 on inferior aspect of the base 330.

This recess 390 is used to unlatch panel 116 from base 330. Pressure on the exposed panel 116 that is below the semicircular recess 390 allows the user to disengage the latch aperture 360 off of the latch protrusion 370 and releases the panel 116 from the base 330. Thus, the base 330 remains in the sink and the panel 116 is hung on a hook from latch aperture 360.

Figure 17:
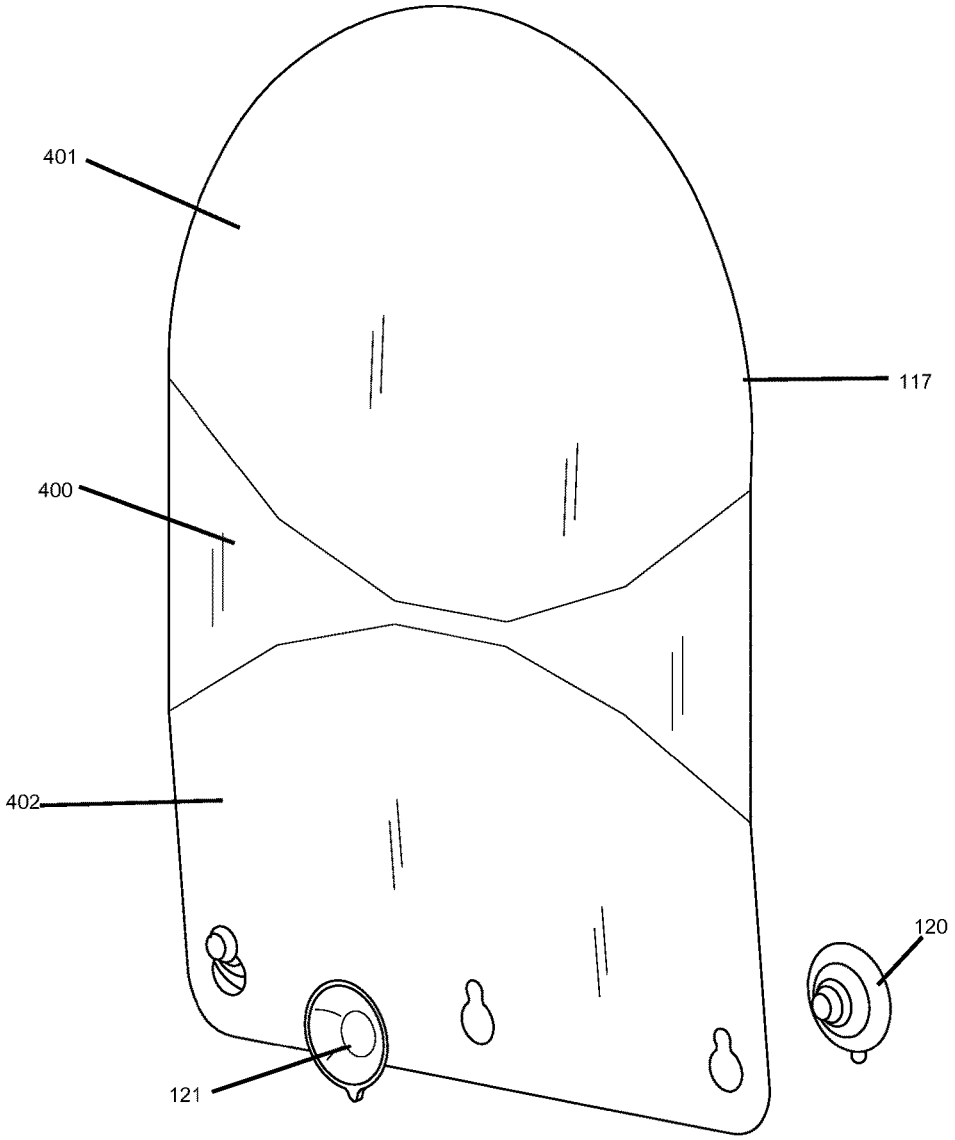
FIG. 17 is a perspective view from the back of the seventh embodiment of the disclosed invention.
Figure 18:
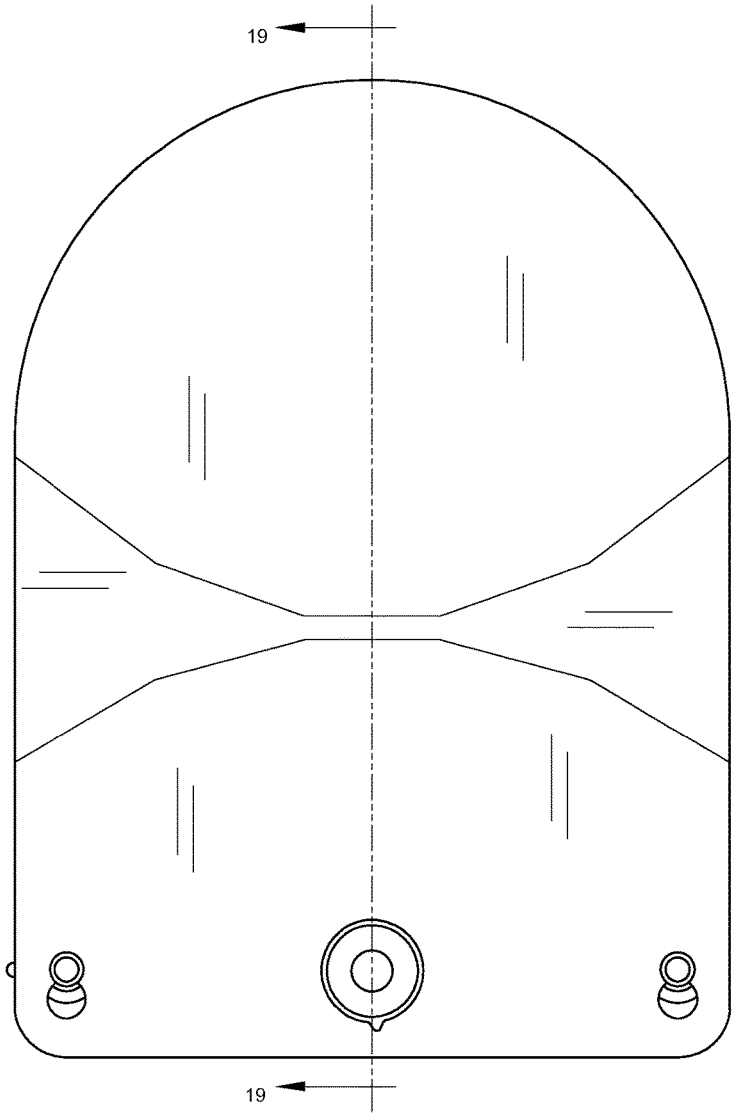
FIG. 18 is a back view of the seventh embodiment of the disclosed invention.
Figure 19:
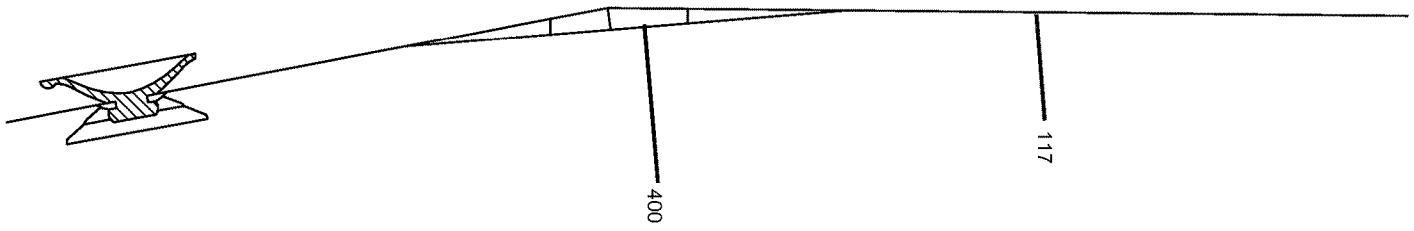
FIG. 19 is a cross sectional view of the seventh embodiment of the disclosed invention.

FIGS. 17 to 19 show a seventh embodiment of the sink splash guard 100. In this embodiment the panel 117 is preferably die cut and vacuum formed. Vacuum formed process is well known in the art of plastics. The mold for this embodiment's vacuum formed process would have three distinct areas. The top part of panel 117 would be one distinct area, a middle distinct area, and a bottom distinct area.

Panel 117 of this embodiment also has butterfly hinged area 400 used to fold the panel 117 over. This butterfly hinged area would be formed by a mold's middle distinct area. This middle distinct area of a mold would be similar to a mountain and thus stretching butterfly hinged area 400 during the vacuum formed process. The butterfly hinged area 400 overcomes folding deformation. The butterfly hinged area 400 height is preferably between 0.25 and 0.5 inches in the center and 4 inches on either side.

The panel 117 further comprises areas below 402 and above 401 the butterfly hinged area 400. These areas 401 and 402 are preferably 5.75 inches at the tallest height. The panel 117 in this embodiment is not flat. Flipping the panel 117 from the folded position to the open position requires the panel 117 contour to invert. The resistance to this inversion generates a force which keeps the panel in the open position. In the open position the area above 401 the butterfly hinge 400 is preferably 190 degrees from the folded over position.

This embodiment further comprises at least three suction cups 120. At least one suction cup 121, preferably the middle suction cup, is placed in the opposite direction to the other suction cups 120. Thus, when panel 117 is folded over, at least one suction cup 121, which is positioned away from the sink wall, attaches to the top half of panel 117. This embodiment gives the option to fold the splash guard out of the way or remove the splash guard 100 when it is not needed.

Figure 20:
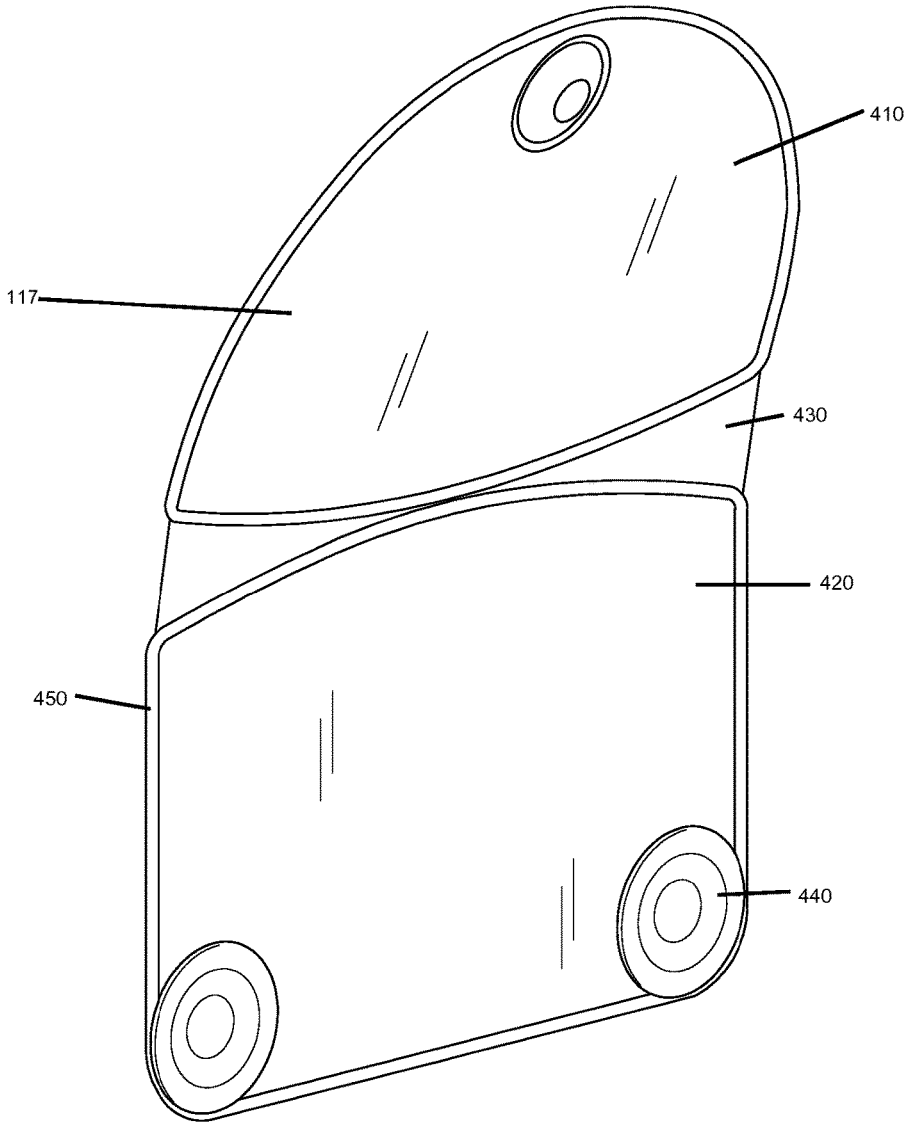
FIG. 20 is a perspective view from the front of an eighth embodiment of the disclosed invention.

FIG. 20 is an eighth embodiment of the sink splash guard 100. This embodiment uses two materials. Panel 117 now has a top section 410 with a height that can be 4.5 inches. Panel 117 now also has a bottom section 420 with a height that can be 5.5 inches. Both sections 410 and 420 are made of the normal preferred materials for the panel 117.

Now the butterfly hinge 430 and over molded suction cups 440 are made of over molded silicone or any rubber or similar material known in the art. Edges 450 are also over molded silicone or similar material. The diameter of suction cups 440 are between 1.125 and 2.375 inches but preferably 1.75 inches when at rest. The diameter in use of suction cups 440 are between 1.25 and 2.5 inches and preferably 1.875 inches. The center of butterfly hinge 430 is 0.25 inches to 0.5 inches in height at the mid-point and at its sides is 2 to 3 inches in height. At least one molded suction cup 440 is located at the top portion 410 of the panel 117 and is used to attach to the bottom panel section 420 holding panel 117 in a folded over position.

Figure 21:
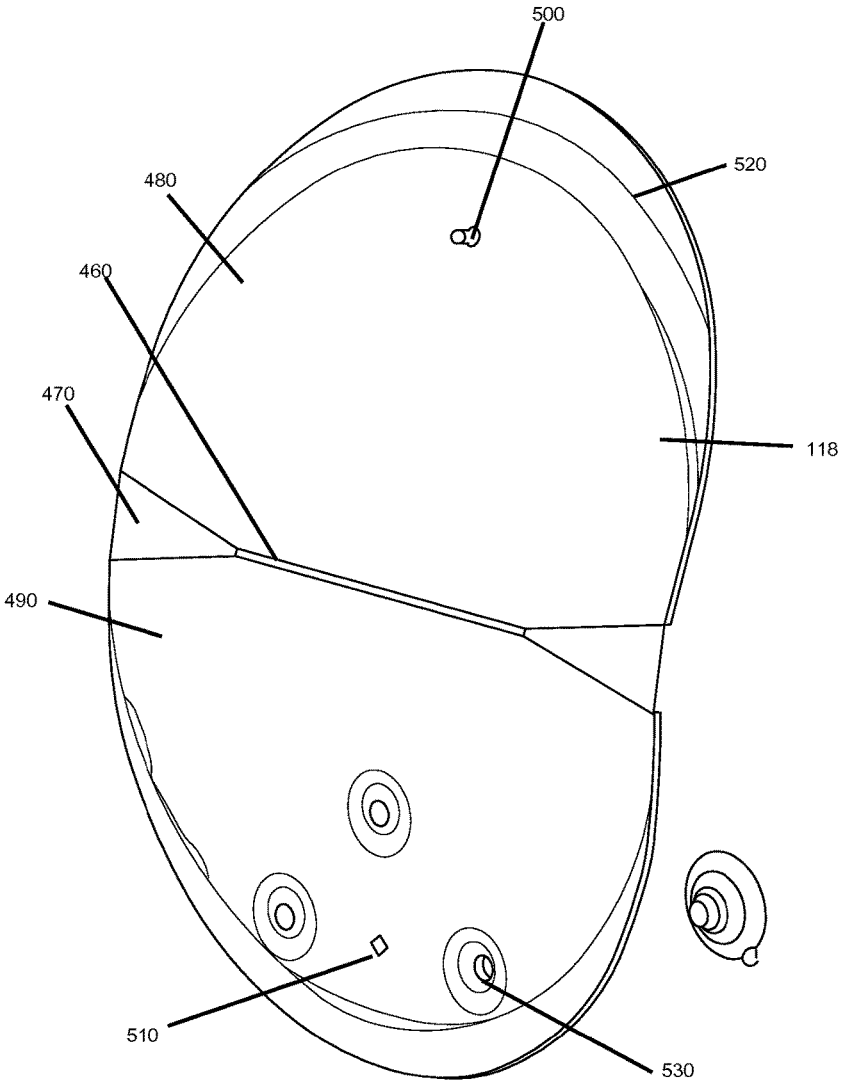
FIG. 21 is a perspective view from the back of a ninth embodiment of the disclosed invention.
Figure 22:
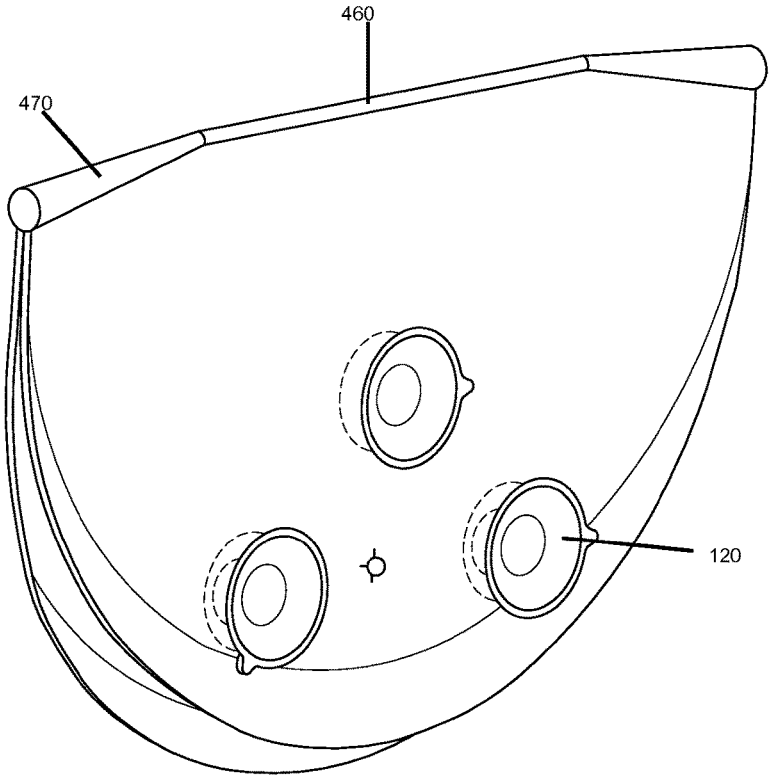
FIG. 22 is a perspective view folded over of a ninth embodiment of the disclosed invention.
Figure 23:
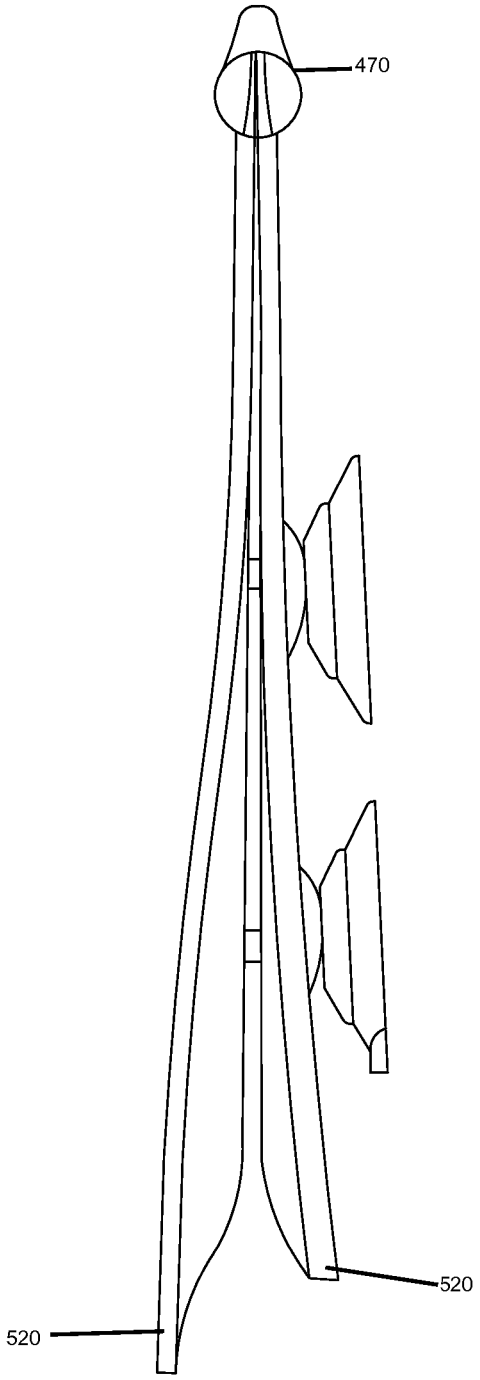
FIG. 23 is a side view folded over of the ninth embodiment of the disclosed invention.
Figure 24:
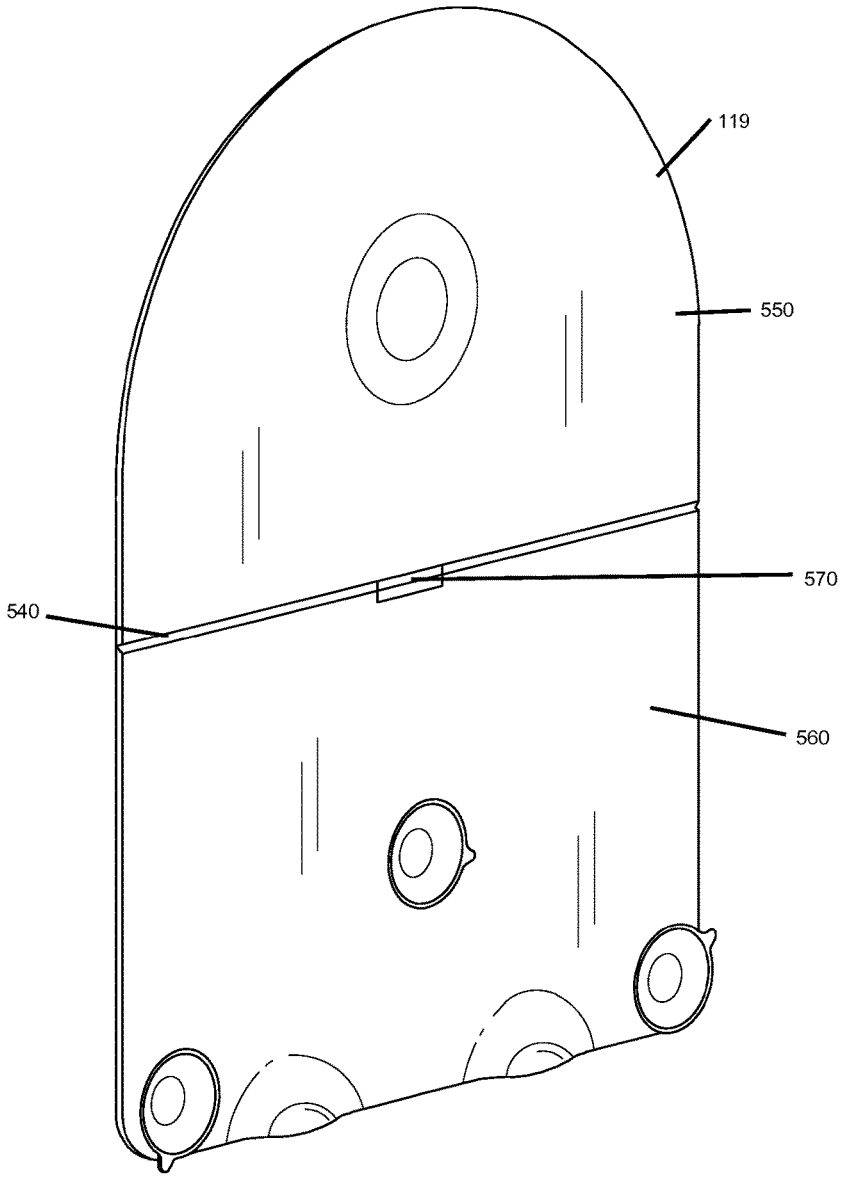
FIG. 24 is a perspective front view of the tenth embodiment of the disclosed invention.
Figure 25:
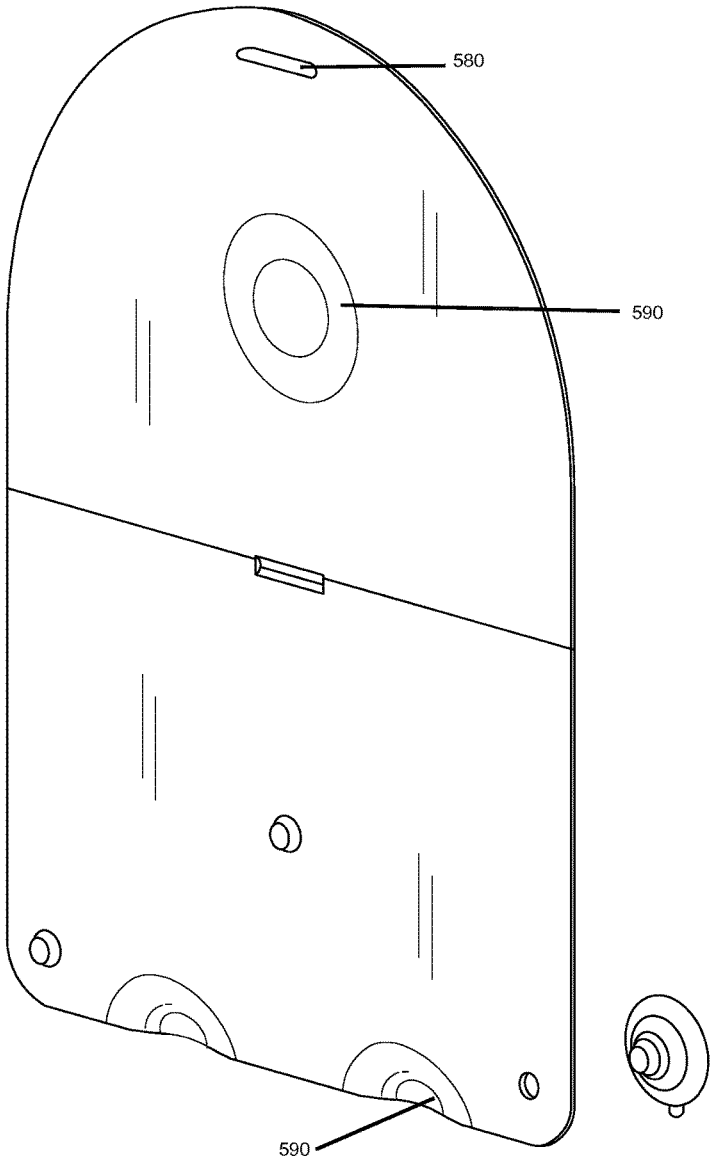
FIG. 25 is a perspective back view of the tenth embodiment of the disclosed invention.

FIGS. 21 to 23 are a ninth embodiment of the sink splash guard. The Panel 118 is now oval in shape and has an upper portion 480 and a lower portion 490. A living hinge 460 is used in conjunction with butterfly hinges 470. This embodiment is preferably produced with injection molding. The upper portion 480 has a protrusion or pin protrusion 500 which has a corresponding socket 510 on the lower portion 490.

When folded over, the protrusion 500 is placed into the socket 510 to hold the panel 118 in a folded position. This ninth embodiment further comprises a lip section 520 on both the bottom edge and top edge. The lip section 520 is preferably a height of 1 inch. This lip section 520 is used to pull open the sink splash guard from the closed position. The suction cup stems 530 are recessed in this embodiment.

FIGS. 24 through 31 are the tenth embodiment of the sink splash guard 100. This embodiment comprises a living hinge 540, an upper section 550 of panel 119 and a bottom section 560. Upper section 550 can be 8.5 inches wide and 5.5 inches in height. Bottom section 560 is can be 8.5 inches wide and 5.5 inches in height. An over center catch 570 holds the panel in the substantially upright unfolded position when engaged.

Figure 29:
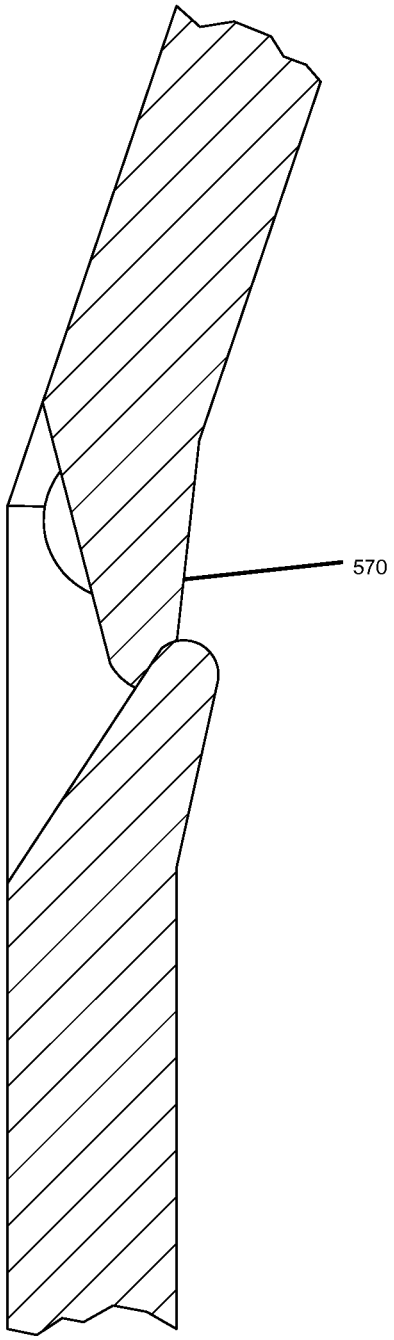
FIG. 29 is a close up cross sectional view of the latch in an open position of the tenth embodiment of the disclosed invention.
Figure 30:
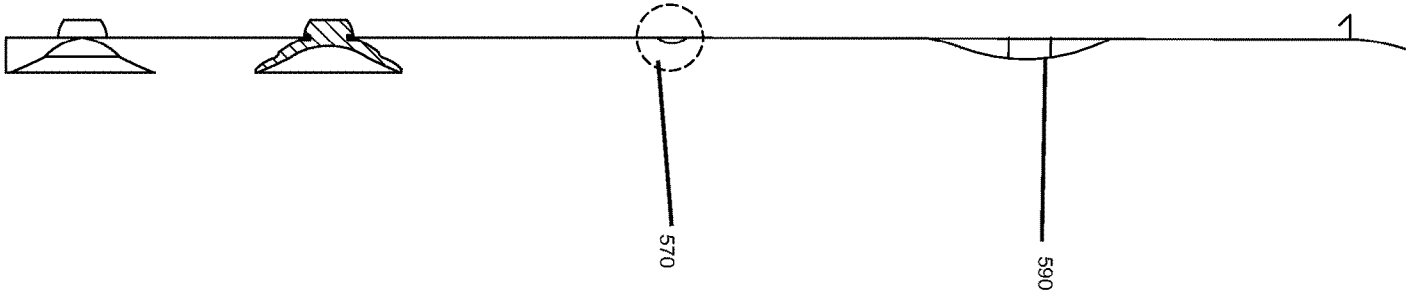
FIG. 30 is a cross sectional view of a latch in a closed position of the tenth embodiment of the disclosed invention.

FIG. 29 shows the detail of the over center catch 570 in an open position, which creates the upright panel 119 position. Top part of catch 570 is engaged behind the bottom part keeping the sink splash guard in an upright position. In an upright position upper section 550 is between 190 to 210 degrees in relation to its folded position.

Figure 26:
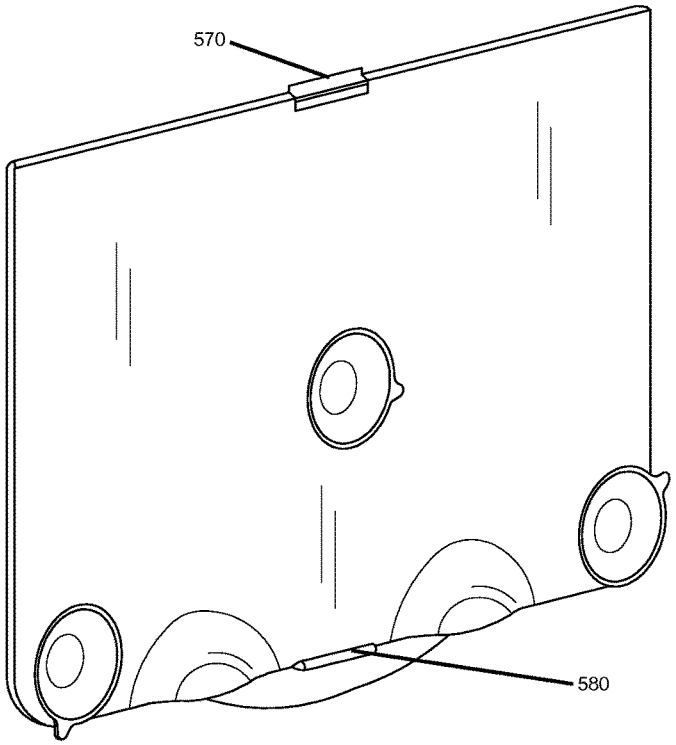
FIG. 26 is a perspective view folded over of the tenth embodiment of the disclosed invention.
Figure 27:
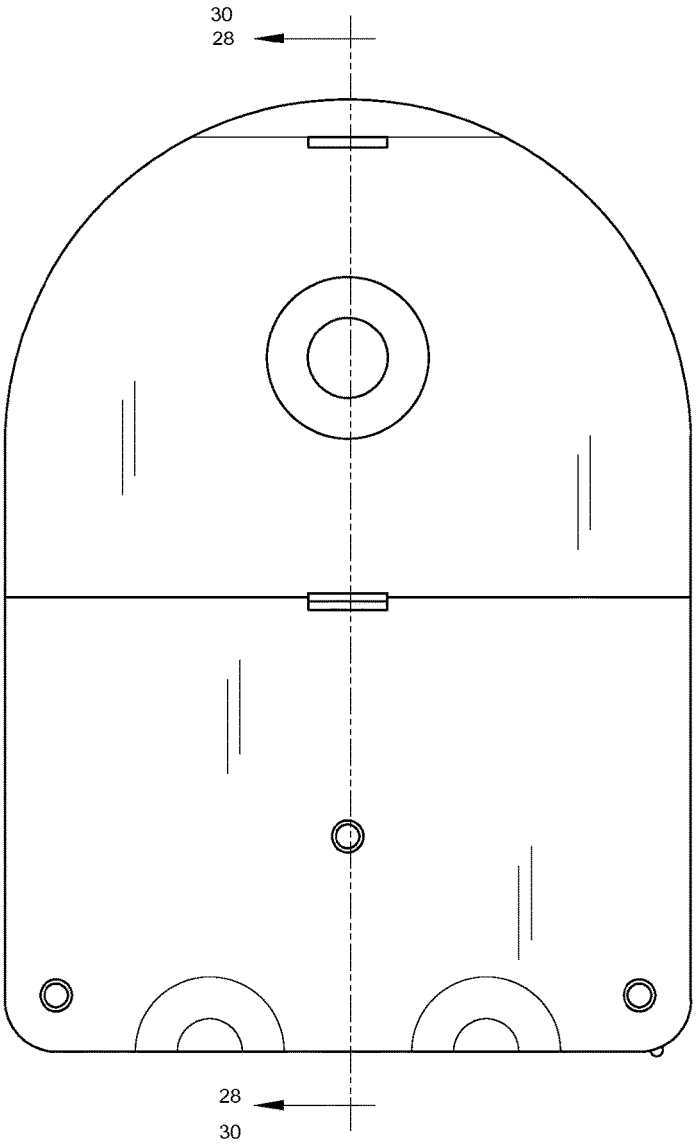
FIG. 27 is a back view of the tenth embodiment of the disclosed invention.
Figure 28:
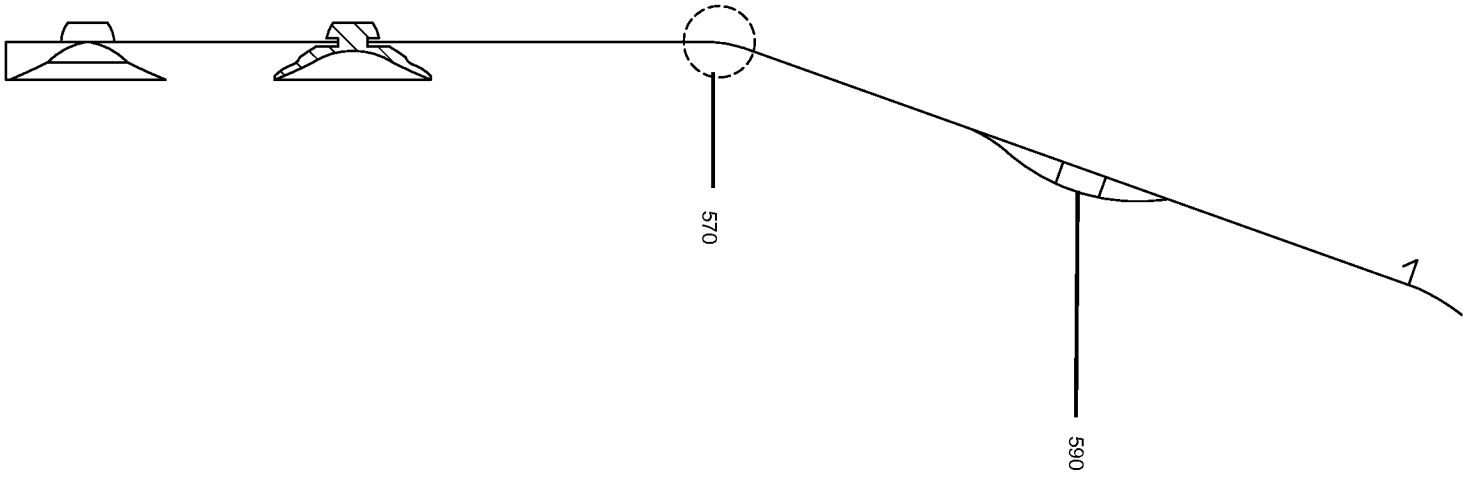
FIG. 28 is a cross sectional view of a latch in an open position of the tenth embodiment of the disclosed invention.
Figure 31:
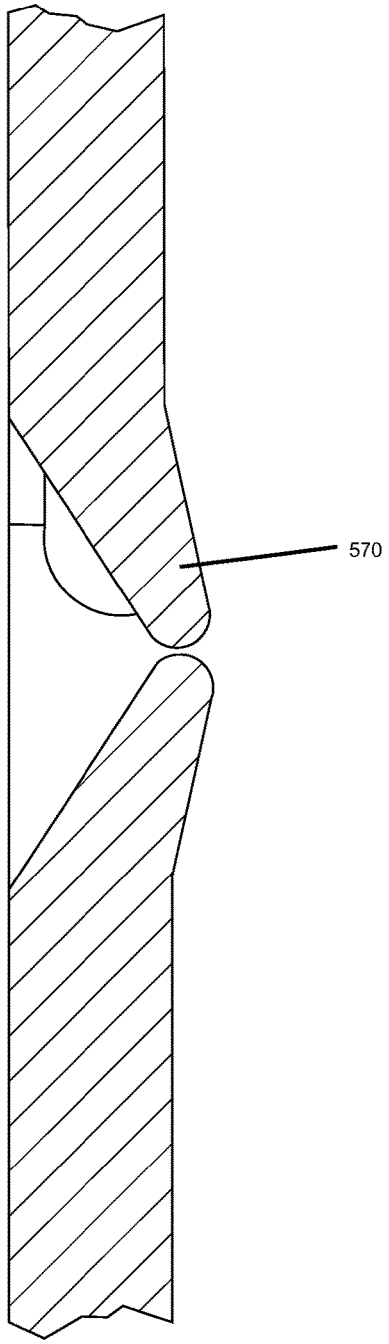
FIG. 31 is a close up cross sectional view of a latch in a closed position of the tenth embodiment of the disclosed invention.

There is a hook 580 near the top edge of upper section 550. The hook 580 snaps over the bottom edge to hold the panel 119 in the folded position, as seen in FIG. 26. The panel 119 further comprises indented portions 590 which assures there will be room for suction cup stems 125 when in the folded position. FIG. 31 shows the over center catch detailed in a closed position or more precisely in a position that allows the panel 119 to fold over.

In all the embodiments a design or logo can be positioned on the top front area of the panel 115 to 119. The top front area of the panel is the side of the panel 115 to 119 that faces the people. This design or logo has many options to apply it to the panel. Stickers, painting, ink stamps, silk screening, heat molded embedded designs are all ways to include the design or logo.

It is recognized by those skilled in the art that changes may be made to the above described embodiments of the disclosed invention without departing from the broad inventive concept thereof. It is understood, therefore, that this invention is not limited to the particular embodiments disclosed but is intended to cover all modifications which are in the spirit and scope of the disclosed invention.

What is claimed:

1. A surface extension attachment device comprising:

at least one panel or other extension attachment;

at least one attaching device;

said at least one attaching device attaching said at least one panel or other extension attachment to at least one surface;

said at least one panel or other extension attachment is connectable or attachable or removable from at least one base, basin, sink, bar, or other structure;

said at least one panel or other extension attachment having at least one of the following:

parts detachably connectable to said at least one base, basin, sink, bar or other structure;

a bottom detachably connectable to said at least one base, basin, sink, bar or other structure;

parts connectable to said at least one base, basin, sink, bar or other structure;

a bottom connectable to said at least one base, basin, sink, bar or other structure;

said at least one panel or other extension attachment folds over itself and is attachable to itself in a manner whereby said at least one panel or other extension attachment remains attached to said at least one surface or at least one surface wall;

a storage mechanism that stores, withdraws, slides, or retracts said at least one panel or other extension attachment while said at least one panel or other extension attachment is attached to, in line with, alongside of, on top of, or side by side with said at least one surface or at least one surface wall, or said at least one base, basin, sink, bar or other structure;

said at least one panel or other extension attachment is shaped as a dome side to side when said at least one panel or other extension attachment is in an unfolded, upright position;

said at least one panel or other extension attachment comprising:

suction cup(s) having stems that are first placed through keyway apertures in a bar and then placed through keyway apertures in the bottom portion of said at least one panel or other extension attachment;

said suction cup(s) being secured to a smaller section of said keyway apertures in a bar, and said keyway apertures in the bottom portion of said at least one panel or other extension attachment;

said dome side to side shape of said at least one panel or other extension attachment being maintained by the placement of said suction cup(s) having a narrower configuration than a distance between keyway apertures in said at least one panel or other extension attachment; and said bar keeping said suction cup(s) in proper narrower configuration.

2. A surface extension attachment device comprising:

at least one panel or other extension attachment;

at least one attaching device;

said at least one attaching device attaching said at least one panel or other extension attachment to at least one surface;

said at least one panel or other extension attachment is connectable or attachable or removable from at least one base, basin, sink, bar, or other structure;

said at least one panel or other extension attachment having at least one of the following:

parts detachably connectable to said at least one base, basin, sink, bar or other structure;

a bottom detachably connectable to said at least one base, basin, sink, bar or other structure;

parts connectable to said at least one base, basin, sink, bar or other structure;

a bottom connectable to said at least one base, basin, sink, bar or other structure;

said at least one panel or other extension attachment folds over itself and is attachable to itself in a manner whereby said at least one panel or other extension attachment remains attached to said at least one surface or at least one surface wall;

a storage mechanism that stores, withdraws, slides, or retracts said at least one panel or other extension attachment while said at least one panel or other extension attachment is attached to, in line with, alongside of, on top of, or side by side with said at least one surface or at least one surface wall, or said at least one base, basin, sink, bar or other structure;

said at least one panel or other extension attachment is shaped as a dome side to side when said at least one panel or other extension attachment is in an unfolded, upright position;

said at least one panel or other extension attachment wherein said dome side to side shape of said at least one panel or other extension attachment comprises at least two suction cups being at an outside, front, bottom portion of said at least one panel or other extension attachment and said at least two suction cups having stems of equal height dimension; and a third suction cup on an inside, front, bottom portion of said at least one panel or other extension attachment between said at least two suction cups, and a stem longer than the dimension of said at least two suction cup stems.

3. A surface extension attachment device comprising:

at least one panel or other extension attachment;

at least one attaching device;

said at least one attaching device attaching said at least one panel or other extension attachment to at least one surface;

said at least one panel or other extension attachment is connectable or attachable or removable from at least one base, basin, sink, bar, or other structure;

said at least one panel or other extension attachment having at least one of the following:

parts detachably connectable to said at least one base, basin, sink, bar or other structure;

a bottom detachably connectable to said at least one base, basin, sink, bar or other structure;

parts connectable to said at least one base, basin, sink, bar or other structure;

a bottom connectable to said at least one base, basin, sink, bar or other structure;

said at least one panel or other extension attachment folds over itself and is attachable to itself in a manner whereby said at least one panel or other extension attachment remains attached to said at least one surface or at least one surface wall;

a storage mechanism that stores, withdraws, slides, or retracts said at least one panel or other extension attachment while said at least one panel or other extension attachment is attached to, in line with, alongside of, on top of, or side by side with said at least one surface or at least one surface wall, or said at least one base, basin, sink, bar or other structure;

said at least one panel or other extension attachment comprising:

said at least one panel or other extension attachment being tablet shaped with a flanged rectangular shaped portion at a bottom of said at least one panel or other extension attachment;

said flanged rectangular shaped portion being narrower in width than said tablet shaped of said at least one panel or other extension attachment, and further comprising a latch aperture;

a base having a semicircular recess, and further comprising a circular latch protrusion and a capture lip on a front side of said base;

said at least one panel or other extension attachment being attached to said base when said flanged rectangular shaped portion is placed onto said capture lip and said latch protrusion, such that said latch protrusion of said base is engaged with said latch aperture of said at least one panel or other extension attachment; and said at least one panel or other extension attachment is removable from base when pressure is exerted on an exposed portion of said at least one panel or other extension attachment that is located below said semicircular recess, which disengages said latch aperture from said latch protrusion and said at least one panel or other extension attachment is released from the base.

* * * * *